US006151004A

United States Patent [19]

Kaneko

[11] Patent Number: 6,151,004

[45] Date of Patent: Nov. 21, 2000

[54] COLOR DISPLAY SYSTEM

[75] Inventor: Yasushi Kaneko, Sayama, Japan

[73] Assignee: Citizen Watch Co., Ltd., Tokyo, Japan

[21] Appl. No.: 09/051,637

[22] PCT Filed: Aug. 15, 1997

[86] PCT No.: PCT/JP97/02841

§ 371 Date: Apr. 16, 1998

§ 102(e) Date: Apr. 16, 1998

[87] PCT Pub. No.: WO98/08213

PCT Pub. Date: Feb. 26, 1998

[30] Foreign Application Priority Data

Aug. 19, 1996 [JP] Japan ..... 8-217354

[51] Int. Cl.[7] ..... G09G 3/36

[52] U.S. Cl. ..... 345/88; 345/50; 345/102

[58] Field of Search ..... 345/88, 50, 87, 345/89, 150, 151, 102; 348/742; 349/19, 29, 30, 61, 68

[56] References Cited

U.S. PATENT DOCUMENTS 5,233,338 8/1993 Surguy ..... 345/88

FOREIGN PATENT DOCUMENTS 62-123624 8/1987 Japan .
6-67149 3/1994 Japan .
6-186528 7/1994 Japan .
6-222360 8/1994 Japan .

*Primary Examiner*—Dennis-Doon Chow
*Attorney, Agent, or Firm*—Armstrong, Westerman, Hattori, McLeland & Naughton

[57] ABSTRACT

In a field-sequential type color display system comprising a light source unit (1) composed of a plurality of color light sources, a light source driving circuit (8) for driving the light source unit, a liquid crystal shutter unit (2) for controlling transmittivity of light rays emitted by the light source unit, a shutter control circuit (9) for controlling the liquid crystal shutter unit, and a synchronous circuit (10) for synchronizing the light source driving circuit (8) with the shutter control circuit (9), a field is composed of a plurality of sub-fields corresponding to the plurality of color light sources of the light source unit (1), and multicolor display is effected by energizing the color light sources for specific colors against the respective sub-fields while controlling the liquid crystal shutter unit (2) according to the respective sub-fields. Further, a delay circuit (7) is provided for delaying lighting times of the respective color light sources of the light source unit (1) from a time for controlling opening and closing of the liquid crystal shutter unit (2) as set by the synchronous circuit (10) by a delay time substantially equivalent to a response time of the liquid crystal shutter unit (2) from an "open" to a "closed" state. With the color display of such arrangement, degradation in color saturation is reduced even when driving the liquid crystal shutter unit (2) at a low voltage, enabling display with excellent chroma.

3 Claims, 17 Drawing Sheets

COLOR DISPLAY SYSTEM

TECHNICAL FIELD

The present invention relates to a field-sequential type color display system wherein a field is composed of a plurality of sub-fields and images in different colors are displayed in each of the sub-fields so that multicolor display is effected by mixing colors while taking advantage of the effect of image synthesis along the time base by human eyes.

BACKGROUND TECHNOLOGY

One type of field-sequential type color display system comprises a display unit for emitting light rays having wavelengths in a wideband, capable of supplying display information by the light rays of varying wavelengths for respective sub-fields and a variable filter unit for selecting light rays in specific wavelength regions for the respective sub-fields among the light rays having wavelengths in the wideband.

Another type of field-sequential type color display system comprises a light source unit capable of emitting light rays of different wavelengths, and a shutter unit for controlling the light rays emitted by the light source unit on the basis of display information, wherein the light source unit is caused to emit light rays in specific colors for the respective sub-fields while controlling the shutter unit in correspondence thereto.

For a color light source, a fluorescent lamp, or a light emitting diode (LED) has been used. In particular, as a result of the recent development of LEDs emitting blue light, it has become feasible to fabricate the field sequential type color display system by combining LEDs emitting light in the three primary colors.

An example of the field sequential type color display system is shown in FIG. 15.

The field-sequential type color display system is provided with a light source unit 1 composed of a plurality of color light sources which emit light rays of various wavelengths, which can be controlled independently of one another. That is, the light source unit 1 comprises a LED box 3 wherein light emitting diodes (LEDs) 4 for emitting three colors, red, green, and blue, respectively, are arranged as the color light sources, and a diffusion plate 5, and it is driven by a light source driving circuit 8.

The field-sequential type color display system is also provided with a liquid crystal shutter unit 2, operated by the agency of liquid crystal elements, as a shutter unit for controlling the transmittivity of the light rays emitted by the light source unit 1. The liquid crystal shutter unit 2 comprises display segments 6, capable of displaying characters and numbers. And the liquid crystal shutter unit 2 is driven by a shutter control circuit 9.

The shutter control circuit 9 and the light source driving circuit 8 are synchronously controlled by a synchronous circuit 10 so as to be driven in synchronization with each other.

A block diagram of the field-sequential type color display system in FIG. 15 is shown in FIG. 16.

The light source unit 1 consists of a red light source R, a green light source G, and a blue light source B composed of LEDs 4 for three colors, which are energized by a red light source signal Lr, a green light source signal Lg, and a blue light source signal Lb, respectively, supplied from the light source driving circuit 8.

The liquid crystal shutter unit 2 is driven by data signals D and a common signal C respectively supplied from the shutter control circuit 9. Timing pulses of each signal are generated in a synchronous circuit 10 for controlling phases of each light source signal and a liquid crystal shutter driving signal in the same manner.

FIG. 17 is a waveform chart showing waveforms of respective signals in the field sequential type color display system shown in FIG. 16 and optical response characteristic of the liquid crystal shutter unit 2 at the driving voltage of 20V for driving the liquid crystal shutter at room temperature.

In this example, for driving the liquid crystal shutter unit 2 by AC, two fields, f1 and f2, are in use and each of the fields consists of three sub-fields, fR, fG, and fB.

As shown in FIG. 17, the red light source signal Lr turns on only in the sub-field fR, while it turns off in the other sub-fields fG and fB. Similarly, the green light source signal Lg turns on only in the sub-field fG while it turns off in the other sub-fields fB and fR. The blue light source signal Lb turns on only in the sub-field fB while it turns off in the other sub-fields fR and fG.

The voltage of the common signal C supplied to the liquid crystal shutter unit 2 becomes c1 in the field f1 and c2 in the field f2.

When a STN liquid crystal panel in normally white mode is used for the liquid crystal shutter unit 2, a data signal Dw for displaying white is in same phase with the common signal C, and as a voltage is not applied to the liquid crystal panel, the liquid crystal shutter unit 2 is switched to the OFF state, while a data signal Dbl for displaying black is in opposite phase with the common signal C, and as the liquid crystal panel is applied with a driving voltage equivalent to a difference in voltage between the common signal C and the data signal Db1, the liquid crystal shutter unit 2 is switched to the ON state.

A data signal for displaying one of the primary colors is at a voltage such that the shutter is in the transmitting state (OPEN) only in one of the sub-fields corresponding to that color. For example, a data signal Dr for displaying red color is at a voltage such that the shutter is in the transmitting state only in the sub-field fR corresponding to red color while it is in the "closed" state in the sub-fields fG and fB.

A data signal Dg for displaying green color is at a voltage such that the shutter is in the transmitting state only in the sub-field fG corresponding to green color, and a data signal Db for displaying blue color is at a voltage such that the shutter is in the transmitting state only in the sub-field fB corresponding to blue color.

In the case that the LED box 3 is adopted for the light source unit 1, the emission characteristics of the red light source signal Lr, green light source signal Lg, and blue light source signal Lb can be regarded the same as those of respective LEDs since the response time of the respective LEDs, which are semiconductors, is very fast.

Meanwhile, the response time of the liquid crystal panel is slower than that of the LED. Response characteristics at room temperature are shown in FIG. 13 in the case where the STN liquid crystal panel is adopted for the liquid crystal shutter unit 2. The solid line shows the ON response time from the "open" to the "closed" state and the dotted line shows the OFF response time from the "closed" to the "open" state.

The OFF response time is determined by the material of the liquid crystal, the thickness of the liquid crystal cells and the angle through which the liquid crystals are twisted, etc., and it is not dependent on the applied voltage and is always on the order of 1.5 to 3 ms (2 ms in the illustrated example) while the ON response time depends greatly on the driving voltage wherein it is 0.1 ms at a driving voltage of 20V but it reaches 4 ms at a driving voltage of 5V.

In FIG. 17, the span of field f1 is preferably set to 20 ms or less for obtaining good mixing of colors without causing a viewer to perceive flicker, and accordingly, the span of the sub-fields, fR, fG, and fB, respectively, are set to about 5 to 6 ms.

A change from the "closed" to "open" state of the transmittivity Tr of the liquid crystal shutter unit 2 for displaying red is delayed from the data signal Dr for displaying red color by 1.5 to 3.0 ms, equivalent to the OFF response time of the liquid crystal panel. Consequently, the amount of light rays transmitted from the red light source is slightly decreased. Similarly, the transmittivity Tg for displaying green switches to the "open" state behind the data signal Dg for displaying green color by 1.5 to 3.0 ms, and the transmittivity Tb for displaying blue switches to the "open" state behind the data signal Db for displaying blue color by 1.5 to 3.0 ms.

However, as the on response time of the liquid crystal panel from the "open" to the "closed" state is as fast as 0.1 ms at the driving voltage of 20V or more, the transmittivity Tr when displaying red is completely in the "closed" state in the sub-field fG with the result that display in red with good chroma is obtained without mixing of colors caused by the green light source. Similarly, the transmittivity Tg when displaying green will cause no mixing of colors caused by the blue light source, and also the transmittivity Tb when displaying blue will cause no mixing of colors caused by the red light source, thereby displaying respective colors with high chroma.

Data signals for displaying a plurality of the primary colors take a voltage, respectively, such that the shutter is in the transmitting (open) state only in the sub-fields corresponding to each color. For example, a data signal for displaying bluish green takes a voltage such that the shutter is in the transmitting state in the sub-fields fG and fB, corresponding to green and blue, respectively, while in the "closed" state in the sub-field fR. A data signal for displaying purple takes a voltage such that the shutter is in the transmitting state in the sub-fields fB and fR, corresponding to blue and red, respectively. A data signal for displaying yellow takes a voltage such that the shutter is in the transmitting state in the sub-fields fR and fG, corresponding to red and green, respectively.

Such a field-sequential type color display system having the arrangement set forth hereinbefore is characterized in that it can effect multicolor display with a simple construction.

However, with the field-sequential type color display system using STN liquid crystal panels adopted for the liquid crystal shutter unit 2 in normally white display mode, the driving voltage is required to be 20V or more for making the on response time fast, which causes a problem in that a driving IC having a high break down voltage is required, or a boosting circuit is required in the driving circuit, leading to increasing cost of the display system.

FIG. 18 is a waveform chart showing waveforms of respective signals in the field-sequential type color display system shown in FIG. 15 at a driving voltage of 9V for driving the liquid crystal panel at room temperature and optical response characteristic of the liquid crystal shutter.

Waveforms of a common signal C and each of data signals Dr, Dg, Db, Dw and Db1 each supplied to the liquid crystal shutter unit 2 are substantially the same as those of the respective signals shown in FIG. 17, but voltages c1 and c2 of the common signal C are smaller than those of the common signal C shown in FIG. 17 and also voltages d1 and d2 of respective data signals D are smaller than those in FIG. 17.

When the driving voltage is lower, the on response time from the "open" to "closed" state of the STN liquid crystal panel slows down in such a manner as shown in FIG. 13 that the on response time is on the order of 1 to 2 ms at the driving voltage of 9V, namely, it is 10 times or more as slow as at the driving voltage of 20V.

In FIG. 18, the transmittivity Tr when displaying red does not soon switch to the "closed" state even in the sub-field fG, since the on response time from the "open" to the "closed" state slows down, but there is generated a mixing portion Tm where red is mixed with green from the green light source to degrade the chroma of red as purity of color, which is in saturation. Likewise, in the case of the transmittivity Tg when displaying green, there is generated a mixing portion Tm where green is mixed with blue from the blue light source, thereby degrading the chroma of green. Also in the case of the transmittivity Tb when displaying blue, there is generated the mixing portion Tm where blue is mixed with red from the red light source, thereby degrading the chroma of blue.

Accordingly, when the driving voltage is lower, the ON response time from the "open" to the "closed" state of the liquid crystal shutter unit 2 is reduced, and the "closed" state becomes incomplete so that light except the displayed color leaks through, leading to the degradation of the chroma in display segment 6 (FIG. 15) displaying the primary colors of red, green and blue. Accordingly, neither a low-cost driving IC having a low break down voltage nor a low-cost circuit having no boosting circuit can be used, thereby increasing the cost of the color display system.

Further, at low temperatures of 0° C. or lower, the OFF response time slows down, the amount of transmitted light decreases to darken the display color, and the ON response time further slows down, thereby increasing the mixing portion Tm when colors are mixed with those from the other light sources, to degrade chroma, which causes a problem that a range of temperature for operating the color display system is limited in a low temperature zone.

DISCLOSURE OF THE INVENTION

The present invention solves the problems set forth hereinbefore, and it is an object of the invention to use a liquid crystal panel for a liquid crystal shutter unit in a field-sequential type color display system capable of reducing the degradation of chroma, and of obtaining display of better color even if the on response time of the liquid crystal shutter unit slows down by lowering a driving voltage, thereby using a driving IC having a low break down voltage and a low-cost circuit dispensing with a booster circuit, thereby reducing the cost of the color display system.

It is another object of the invention to provide a field-sequential type color display system capable of restraining the degradation of color saturation to obtain display with satisfactory chroma even if the response time of the liquid crystal shutter unit slows down when temperature falls, thereby expanding the operable temperature range of the field-sequential type color display system to include low temperature zones.

To achieve the above object, the field-sequential type color display system as described hereinbefore is provided with a delay circuit for delaying lighting times of the respective color light sources from a time for controlling opening and closing of the liquid crystal shutter unit by a delay time substantially equivalent to a response time of the liquid crystal shutter unit from an "open" to a "closed" state, thereby reducing the mixing portions of colors and restraining the degradation of color saturation.

Further, there are provided a temperature detection unit for detecting the ambient temperature, and a temperature-compensating circuit for varying the delay time by means of the delay circuit according to temperatures detected by the temperature detection unit, thereby reducing the degradation of color saturation even at a low temperature, to obtain a color display with satisfactory chroma.

Further, a light emission suspension period substantially equivalent to a response time of the liquid crystal shutter unit from an "open" to a "closed" state may be provided at the beginning of a lighting period of the respective color light sources of the light source unit applied by the light source driving circuit.

Alternatively, a shutter control circuit may provide a reset period substantially equivalent to a response time of the liquid crystal shutter unit from the "open" to the "closed" state at the end of the span of the respective sub-fields of shutter control signals for controlling the liquid crystal shutter unit.

Still further, a synchronous circuit renders the span of one of the plurality of the sub-fields constituting one field, during which any one of the color light sources is energized, longer than the span of any other of the sub-fields, during which other color light sources are energized, thereby enabling a satisfactory color display even with a reduced number of high-cost light sources (e.g. blue-color LEDs).

BEST MODE FOR CARRYING OUT THE INVENTION

Figure 1:
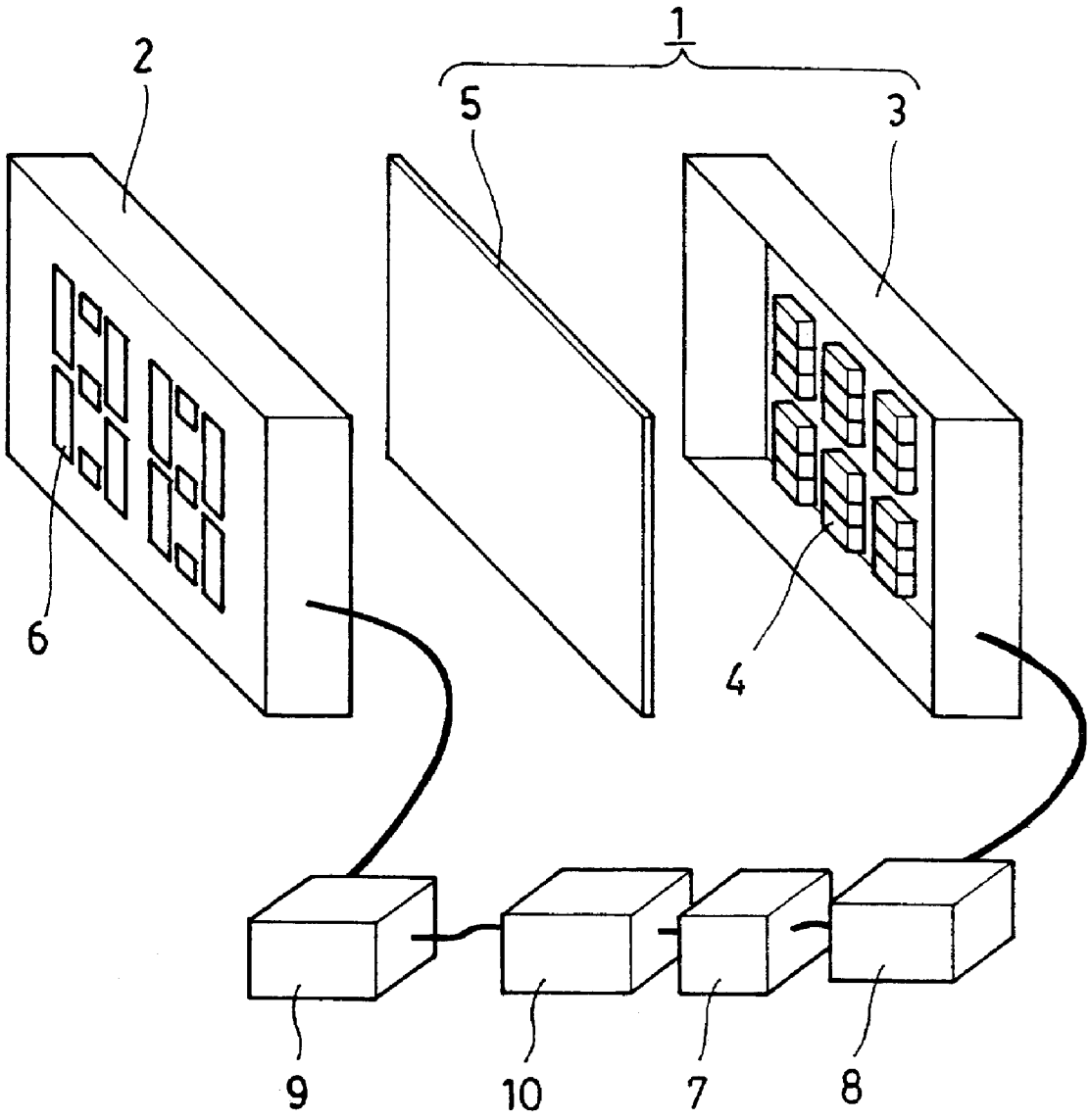
FIGS. 1, 4, 7, 9 and 11 are perspective views respectively showing a field-sequential type color display system according to first, second, third, fourth and fifth embodiments of the invention.

A color display system according to various embodiments of the invention will now be described with reference to the attached drawings. Respective embodiments relate to a field-sequential type color display system employing an STN liquid crystal panel in the liquid crystal shutter unit.

Parts which are used to explain the embodiments shown in FIGS. 1 to 12 are denoted by the same reference numerals as those used to explain the prior art as shown in FIGS. 15 to 18.

First Embodiment (FIGS. 1 to 3):

The color display system according to the first embodiment of the present invention is first described with reference to FIGS. 1 to 3.

Figure 2:
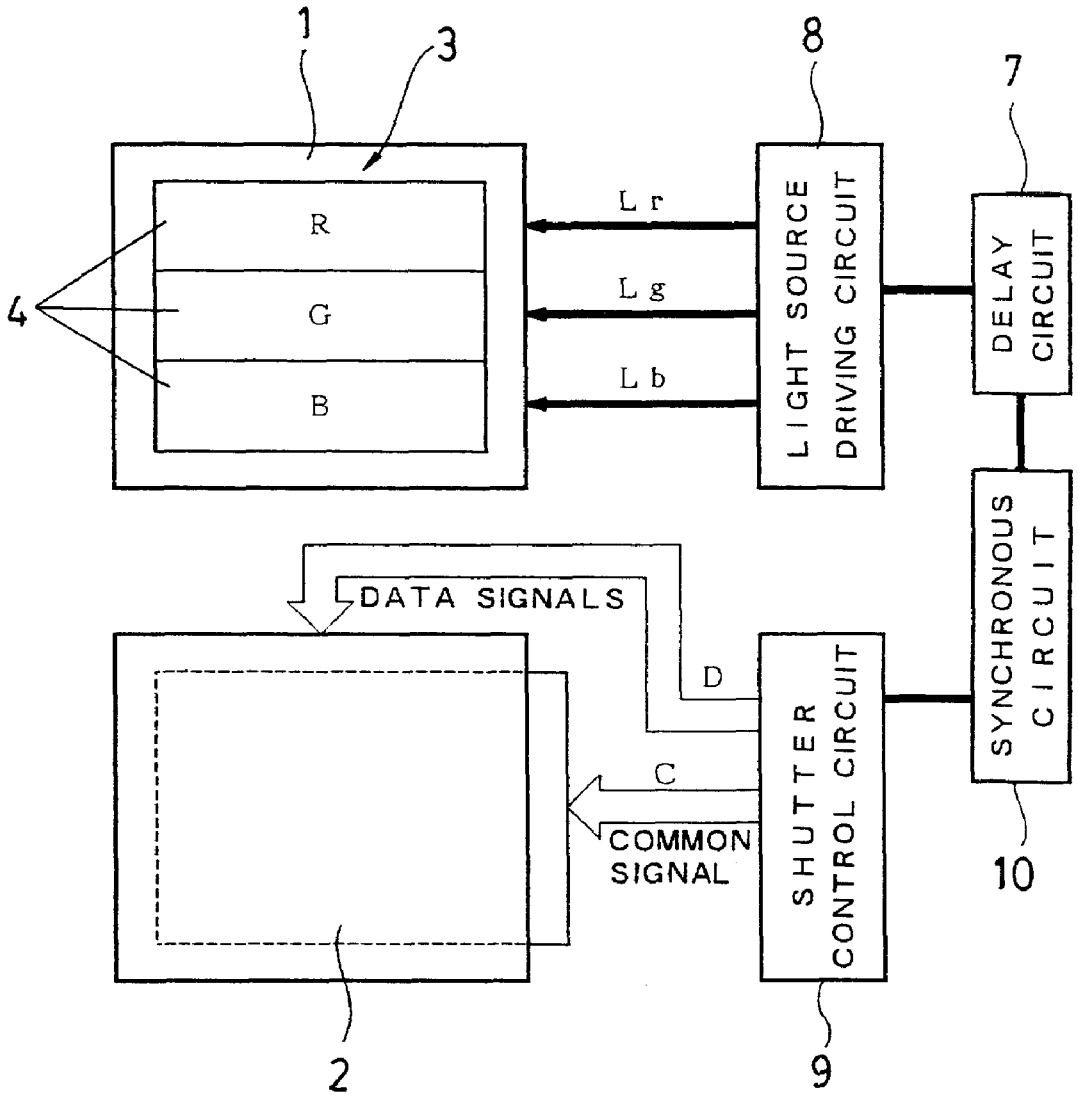
FIGS. 2 and 5 are block diagrams showing constructions of the field-sequential type color display system according to the first and second embodiments of the present invention.

FIGS. 1 and 2 are a perspective view and a block diagram respectively showing the construction of the first embodiment of the present invention.

Figure 15:
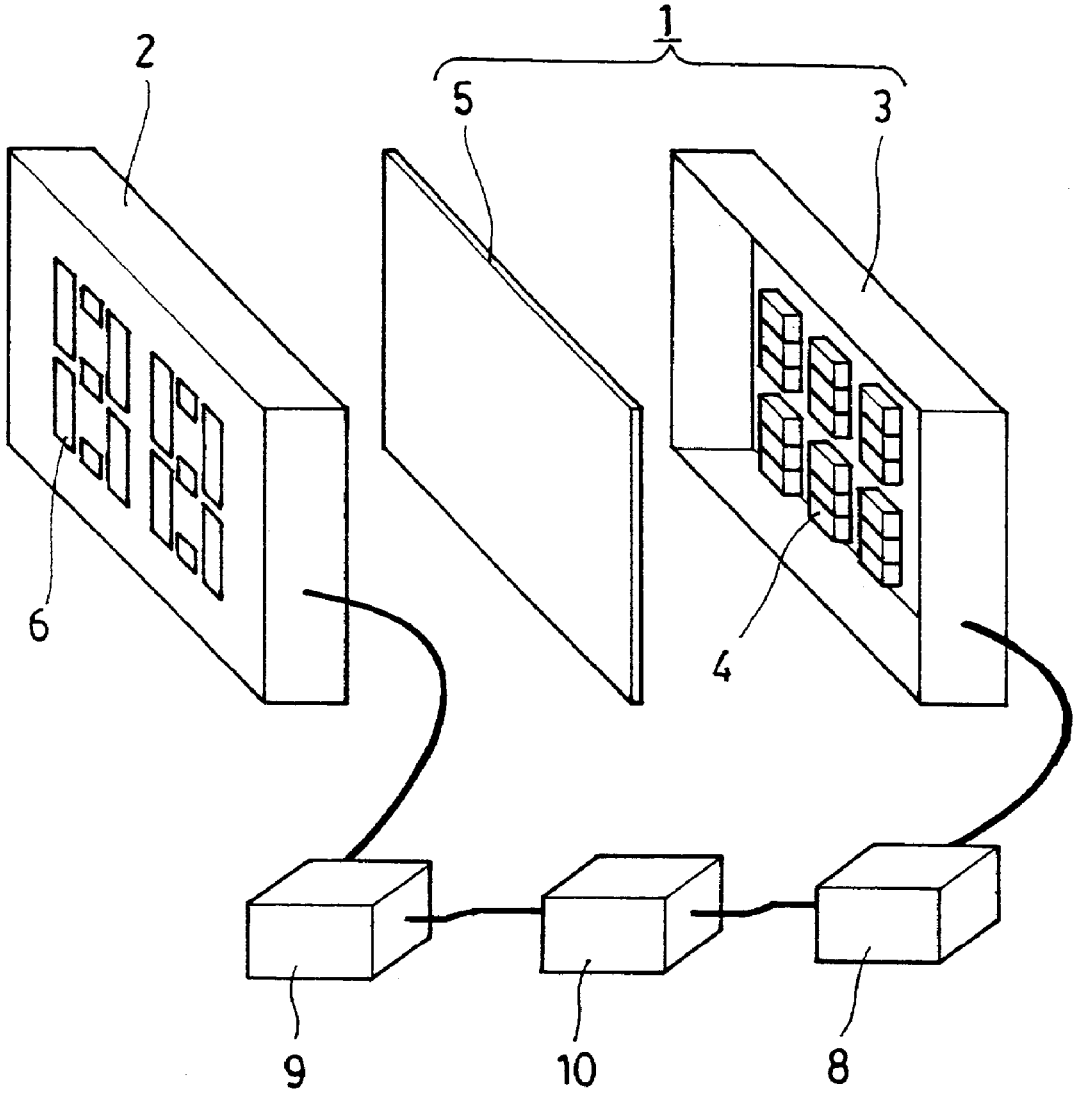
FIG. 15 PRIOR ART
FIG. 15 is a perspective view of a construction of a conventional field sequential type color display system.
Figure 16:
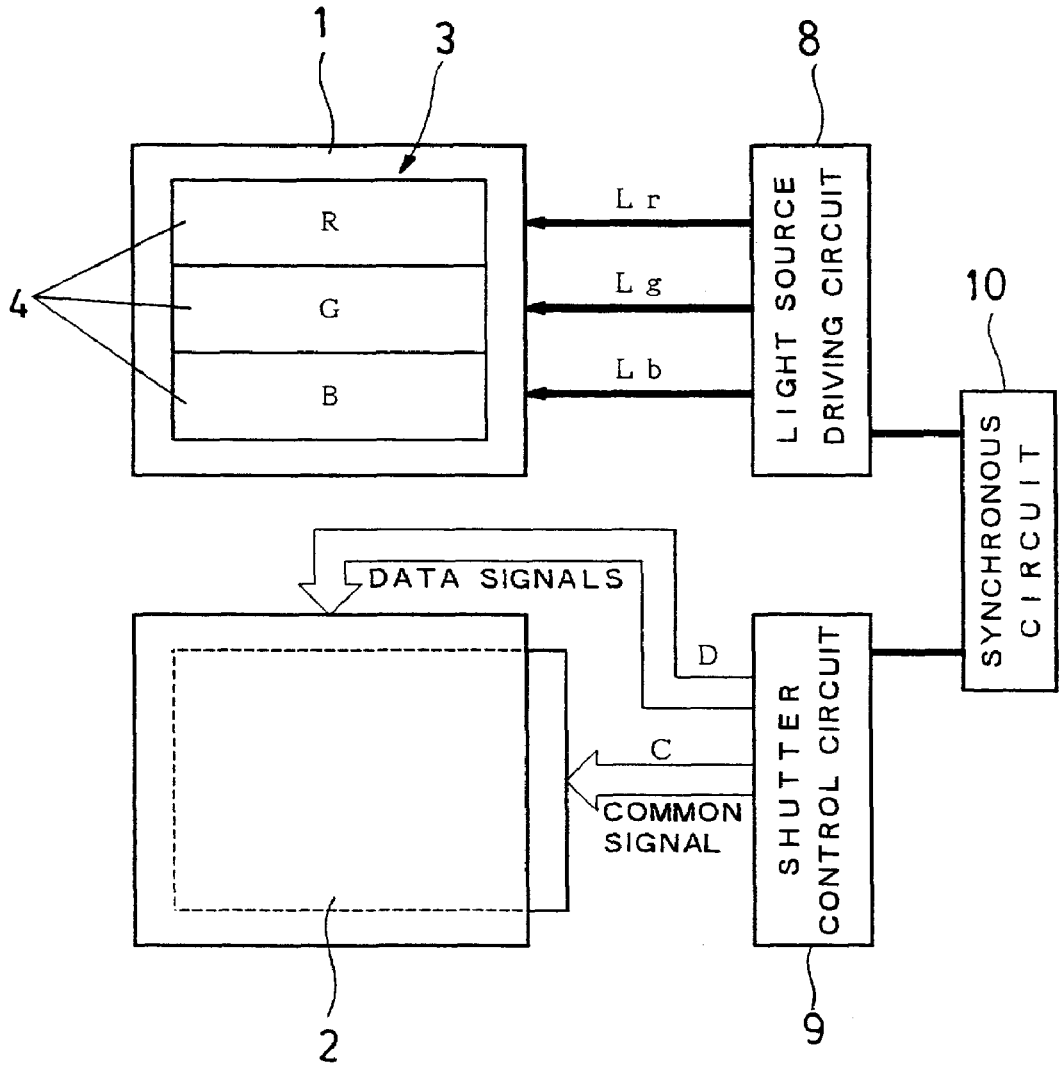
FIG. 16 PRIOR ART
FIG. 16 is a block diagram showing the construction of the conventional field-sequential type color display system.
Figure 17:
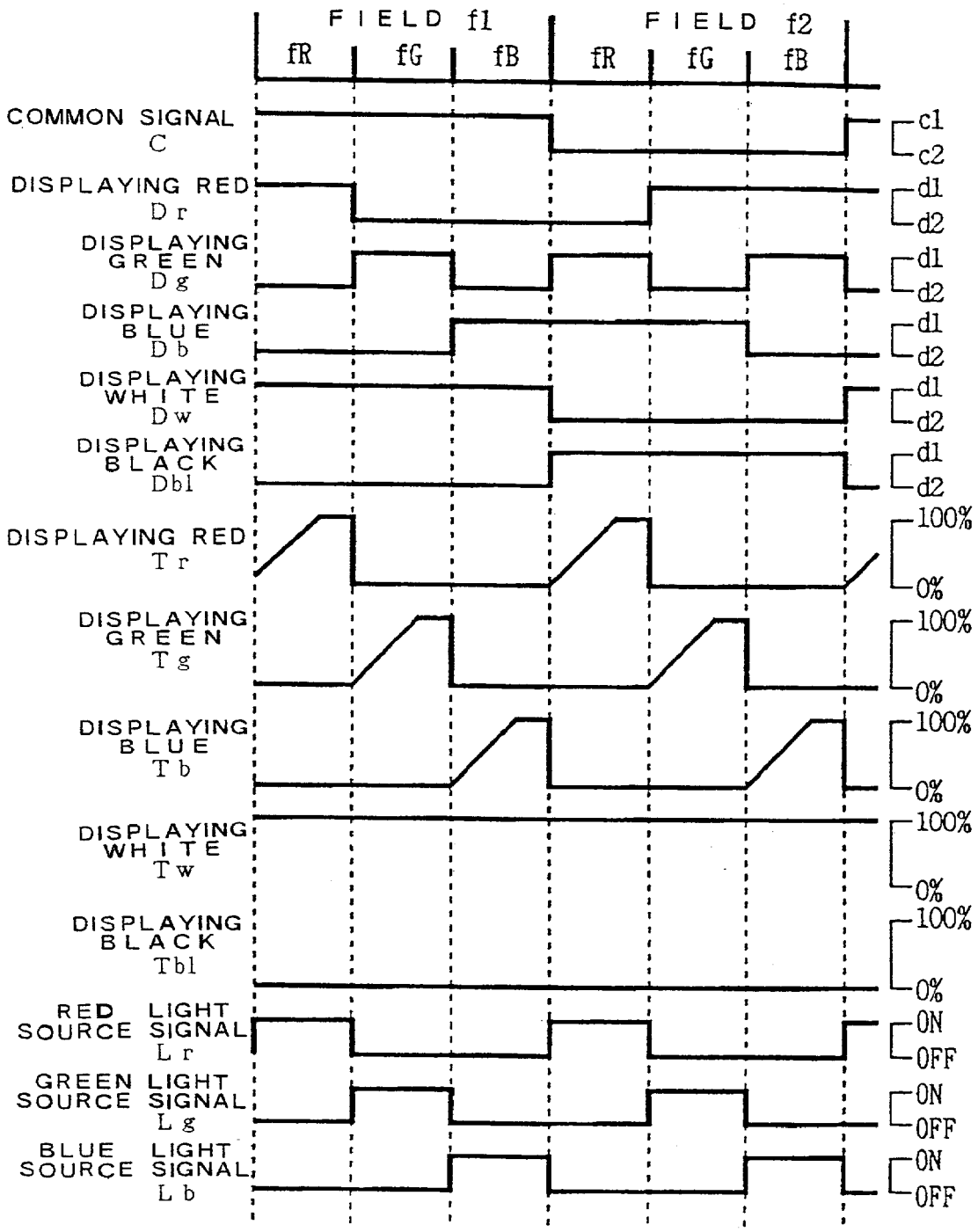
FIG. 17 PRIOR ART
FIG. 17 is a waveform chart showing waveforms of respective signals in the case where a driving voltage applied to the liquid crystal shutter unit of the color display system is 20V, and showing the optical response characteristic of the liquid crystal shutter unit.

The first embodiment is different from the prior art shown in FIGS. 15 and 16 in respect of the provision of a delay circuit 7 between the synchronous circuit 10 and the light source driving circuit 8.

Although other constructions are the same as those of the prior art, they will be explained again briefly for cautions' sake. The light source unit 1 comprises the LED box 3 in which a plurality of LEDs 4 each composed of three colors of red, green and blue are arranged, as color light sources and the diffusion plate 5, and the light source unit 1 is driven by the light source driving circuit 8.

Further, the color display system includes the liquid crystal shutter unit 2 using a liquid crystal panel and having a signal electrode to which data signals are input and a common electrode to which a scan signal is input for controlling transmittivity of light rays emitted by the light source unit 1.

The liquid crystal shutter unit 2 has display segments 6 capable of displaying characters and numbers. However, the liquid crystal shutter unit is not limited to the segment type but may also be of a matrix type.

The liquid crystal shutter unit 2 is driven and controlled by the shutter control circuit 9. The light source driving circuit 8 is connected to the synchronous circuit 10 through the delay circuit 7, and the shutter control circuit 9 is also connected to the synchronous circuit 10.

In this embodiment, there is employed an STN liquid crystal panel for the liquid crystal shutter unit 2, wherein the STN liquid crystal panel is in normally white mode, namely, it is in the "open" state, i.e., a transparent state, when the OFF voltage is applied, and it is in the "closed" state, i.e., in the light interception state, when the ON voltage is applied.

The performance of the liquid crystal shutter is optimized under the following conditions.

Liquid crystal molecules are twisted by 240° between two glass substrates, and each polarized axis of the polarizing films which are disposed vertically is arranged at an angle of about 45° relative to the liquid crystal molecules positioned between the upper and lower glass substrates. That is, the upper polarizing film is disposed at an angle of +45° and the lower polarizing film is disposed at an angle of −45° relative to the predominating direction of the liquid crystal panel, and the crossing angle of the upper and lower polarizing films is about 90°.

Suppose that the thickness of a liquid crystal layer, i.e., the cell gap, is set to d, and the birefringence of the liquid crystal is set to Δn, then the retardation expressed by the product of Δn and d is about 800 nm. The crossing angle of the polarizing films can be narrowed to 80° to 85° to adjust the background color.

The relation of the response time of the STN liquid crystal panel relative to the driving voltage at room temperature is the same as that explained with reference to FIG. 13. The ON response time shown by the solid line is strongly dependent on the driving voltage, and it is about 0.1 ms when the driving voltage is 20V but it becomes about 1 ms when the driving voltage is 9V, namely, it slows down by about 10 times.

The OFF response time shown by the dotted line is the response time from the "closed" state to the "open" state when the driving voltage is returned to 0V and it is substantially determined by the cell conditions, such as the type of liquid crystal material, the thickness of the liquid crystal panel and the angle through which the liquid crystals are twisted, and it is largely independent of the driving voltage.

The STN liquid crystal panel used in this embodiment is optimized to reduce the OFF response time so that the OFF response time is 2 ms or lower at room temperature.

Next, according to the block diagram shown in FIG. 2, the LED box 3 in the light source unit 1 comprises a red light source R, a green light source G and a blue light source B, serving as color light sources composed of LEDs 4 for three colors, and they are energized by a red light source signal Lr, a green light source signal Lg and a blue light source signal Lb supplied from the light source driving circuit 8.

The liquid crystal shutter unit 2 is driven by the data signals D and the common signal C supplied from the shutter control circuit 9.

In the prior art shown in FIG. 16, the light source driving circuit 8 and the shutter control circuit 9 are synchronized with each other by the synchronous circuit 10, and the control of lighting the light source unit 1 and the control of opening and closing of the liquid crystal shutter unit 2 are performed with the same timing.

However, in this embodiment, when the synchronizing signal from the synchronous circuit 10 is delayed by the delay circuit 7 by about 1 ms and then inputted to the light source driving circuit 8, the lighting time of respective color light sources of the light source unit 1 by the light source driving circuit 8 is delayed relative to the opening and closing times of the liquid crystal shutter unit 2 by the shutter control circuit 9 by about 1 ms, corresponding to the ON response time from the "open" to the "closed" state of the liquid crystal shutter unit 2 at the driving voltage of 9V.

Figure 3:
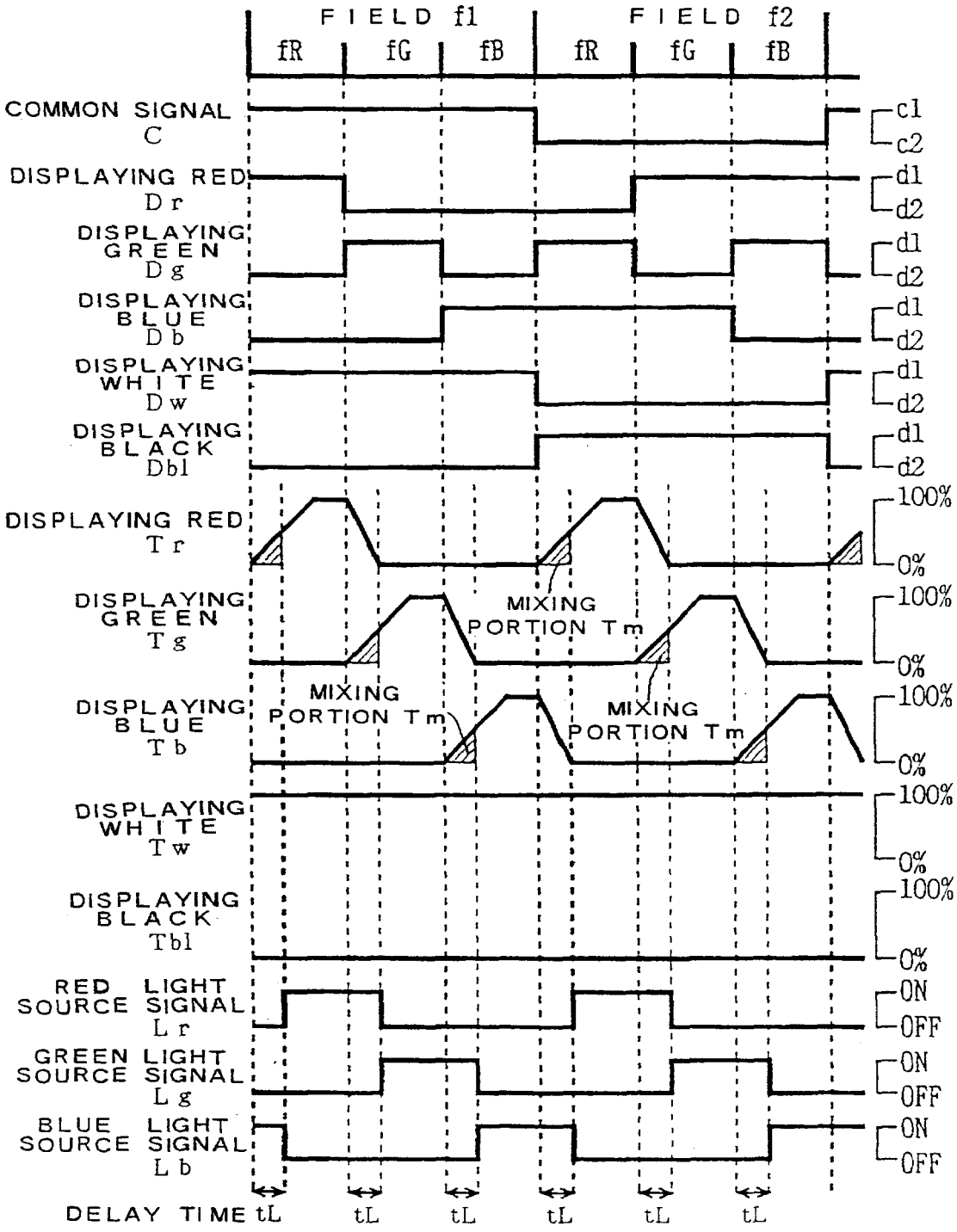
FIGS. 3, 6, 8, 10 and 12 are waveform charts showing waveforms of respective signals applied to light source units and liquid crystal shutter units and optical response characteristic of the liquid crystal shutter unit of the field-sequential type color display system according to the first, second, third, fourth and fifth embodiments of the present invention.

FIG. 3 is a waveform chart showing waveforms of respective signals and the optical response characteristic of the liquid crystal shutter unit 2 at room temperature in the color display system of the first embodiment.

Two fields f1 and f2 are provided for driving the liquid crystal shutter by AC. Each field is composed of three sub-fields fR, fG and fB.

It is preferable that the spans of the fields f1 and f2 be 20 ms or less to obtain excellent mixing of colors without causing a viewer to perceive flicker, and it is set to 15 ms in this embodiment. Accordingly, the spans of sub-fields fR, fG and fB are set to 5 ms.

Owing to the function of the delay circuit 7, the red light source signal Lr turns on only for the duration behind a time when it is delayed from the span of the sub-field fR of the liquid crystal shutter unit by the delay time tL, and it turns off in other sub-fields fG and fB. Likewise, the green light source signal Lg turns on only for the duration behind a time when it is delayed from the span of the sub-field fG of the liquid crystal shutter unit by the delay time tL and turns off in other sub-fields fR and fB. The blue light source signal Lb turns on only for the duration behind a time when it is delayed from the span of the sub-field fB of the liquid crystal shutter unit by the delay time tL and it turns off in other sub-fields fR and fG.

In the case that the LED box 3 is adopted for the light source unit 1, the emitting characteristic of each LED 4 for the respective colors, i.e. red light source signal Lr, green light source signal Lg and blue light source signal Lb can be regarded as the same since the response times of the respective LEDs, which are semiconductors, are very fast.

The voltage of the common signal C supplied to the liquid crystal shutter unit 2 becomes c1 in the field f1, and c2 in the sub-field f2.

Since the STN liquid crystal panel in normally white mode is used for the liquid crystal shutter unit 2 in this embodiment, the data signal Dw for displaying white is in phase with the common signal C where no voltage is applied to the liquid crystal panel, turning the same into the OFF state, while the data signal Db1 for displaying black is in opposite phase with the common signal C where the differential voltage between the common signal C and the data signal Db1 is applied to the liquid crystal, turning the liquid crystal panel into the on state. In this embodiment, the voltages c1 and c2 of the common signal C and the voltages d1 and d2 of the data signal D are adjusted so that the driving voltage becomes 9V.

Accordingly, a low-cost IC having a break down voltage of 10V can be used for the driving IC, and the driving circuit can be directly driven by a car-mounted battery at 12V when the color display system is used as a car-mounted display, and hence a boosting circuit is dispensed with.

Figure 18:
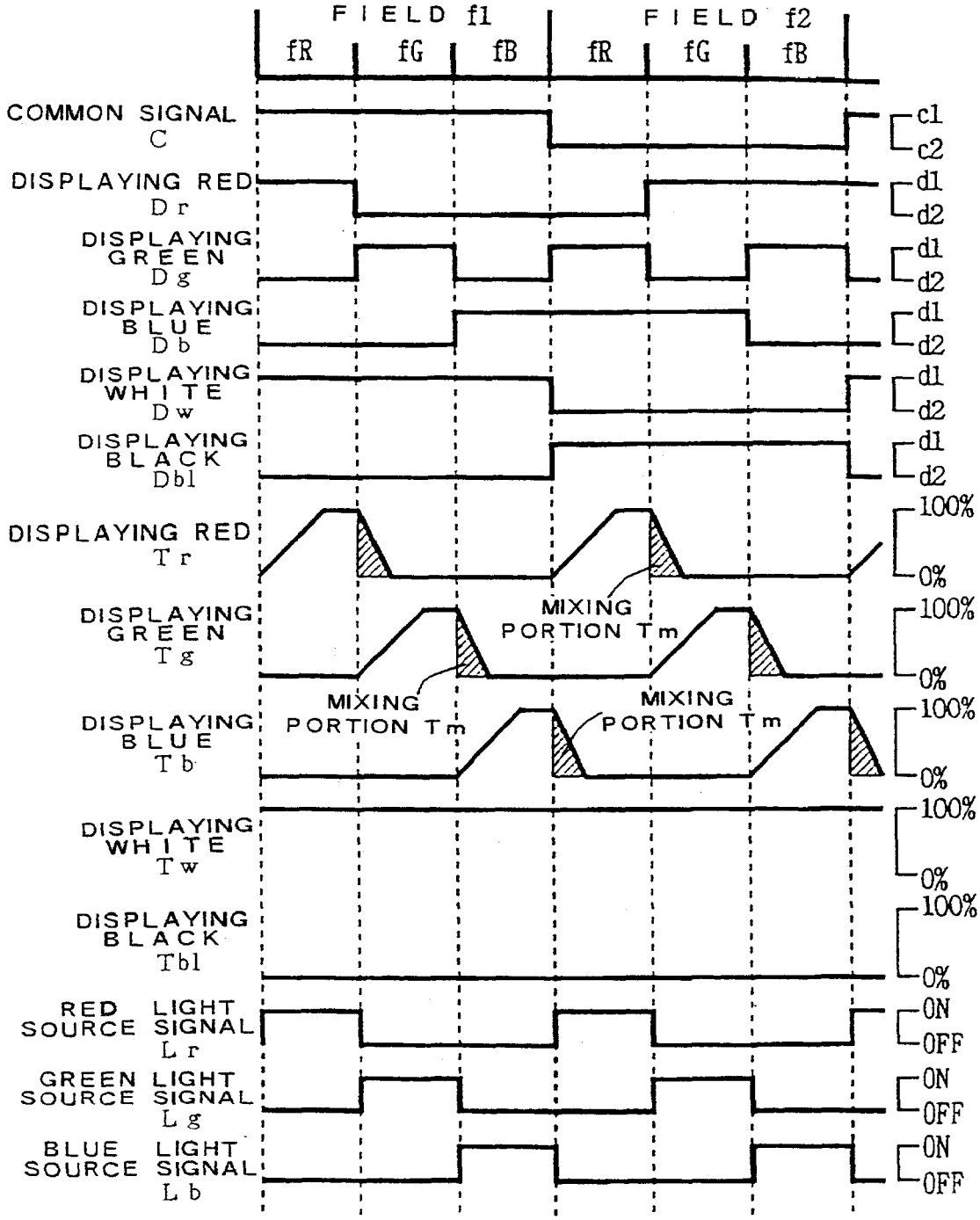
FIG.18 PRIOR ART
FIG. 18 is a waveform chart showing waveforms of respective signals in the case where a driving voltage applied to the liquid crystal shutter unit of the color display system is 9V, and showing the optical response characteristic of the liquid crystal shutter unit.

The change of voltages of the data signal Dr, data signal Dg and data signal Db when displaying a single primary color is the same as the waveform shown in FIG. 18 showing the prior art case at the driving voltage of 9V, and the data signals Dr. Dg and Db take voltages such that the shutter becomes transparent (white) only in the sub-field corresponding to respective color.

The same applies to the change of voltages of the data signal Dr, data signal Dg and data signal Db when displaying a plurality of primary colors, namely, data signals Dr, Dg and Db take such voltages that the shutter becomes transparent (white) only in the sub-field corresponding to the respective colors.

Owing to the reduction of the driving voltage to 9V, although the OFF response time from the "closed" to the "open" state of the STN liquid crystal panel remains unchanged, i.e. about 2 ms, the ON response time from the "open" to the "closed" state slows down to about 1 ms. Accordingly, the delay time tL is set to about 1 ms, which is the on response time.

Consequently, the transmittivity Tr representing the optical response characteristic of the liquid crystal shutter unit 2 when displaying red reaches 100%, i.e., the "open" state, in the field f1 about 2 ms behind the time when the data signal Dr for displaying red switches to the OFF voltage d1. On the other hand, the transmittivity reaches 0%, i.e., the "closed" state, about 1 ms behind the time when the data signal Dr switches to the ON voltage d2.

Since the red light source signal Lr is applied upon a delay of about 1 ms as the delay time tL in the sub-field fR of the liquid crystal shutter unit, it remains applied until the liquid crystal shutter unit completely closes, resulting in no mixing of the green light source G.

However, the blue light source signal Lb remains applied for a period of about 1 ms from the beginning of the span of the sub-field fR, and so mixing of the red light source R and blue light source B occurs. However, the amount of the mixing portion Tm is about half of the mixing portion Tm of the prior art shown in FIG. 18 since the ON response time is about two times the OFF response time as shown in FIG. 3, hence thereby reducing the degradation of chroma.

Figure 13:
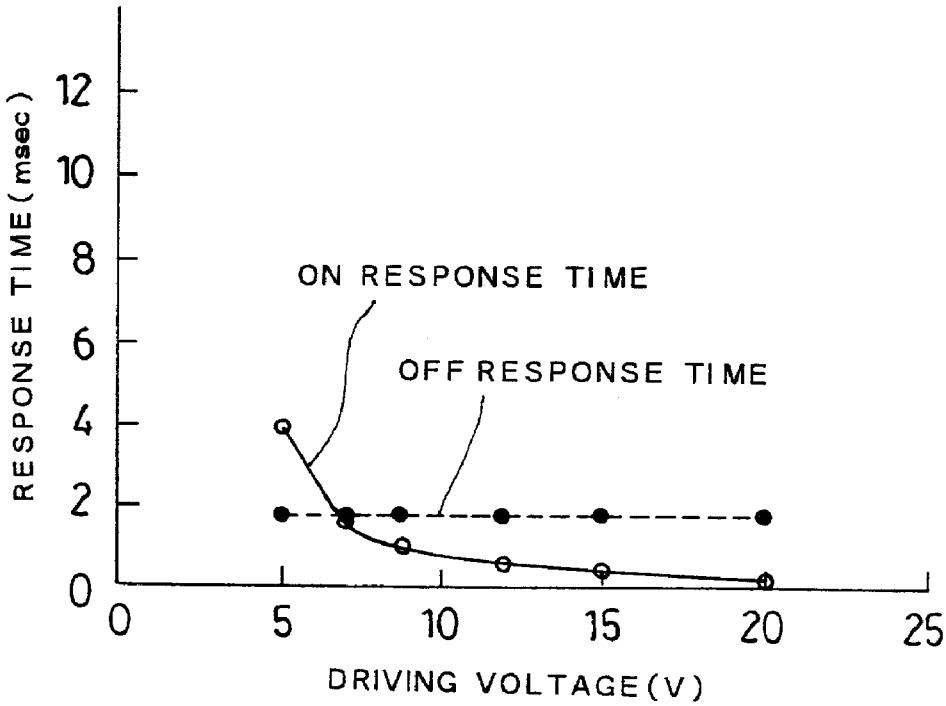
FIG. 13 is a graph showing dependency characteristic of the response time of the liquid crystal shutter used in the liquid crystal shutter unit of the field sequential type color display system relative to a driving voltage.

As shown in FIG. 13, since the ON response time from the "open" to the "closed" state is faster than the OFF response time from the "closed" state to the "open" state at a driving voltage of 7V or more, the mixing portion Tm of the liquid crystal shutter unit can be reduced compared with that of the prior art when the delay time tL is set to the on response time at respective driving voltages, thereby reducing the degradation of the chroma.

In the field-sequential type display system according to the first embodiment of the invention explained hereinbefore, even if the STN liquid crystal panel is adopted for the liquid crystal shutter unit while the driving voltage is set to a low voltage of about 9V, color display of high saturation with high chroma is attained, thereby enabling use of a driving IC and a power supply circuit which are available at low cost to obtain a low-cost color display system.

Although the data signals Dr, Dg, Db, Dw and Db1 shown in FIG. 3 always take the voltage of d1 or d2 in respective sub-fields, they can take an intermediate value on the voltage axis or time axis to display multicolors other than the primary colors. A case where the voltage axis has multiple values corresponds to amplification modulation and a case where the time axis has multiple values corresponds to pulse width modulation. Accordingly, the color display system can display many colors corresponding to the intermediate values if a single primary color, plural primary colors, and driving waveforms are devised.

Although the delay circuit 7 is provided separately in the first embodiment for facilitating the explanation, the synchronous circuit 10 or light source driving circuit 8 may include the function of the delay circuit 7.

Second Embodiment (FIGS. 4 to 6):

The color display system according to the second embodiment of the invention will now be described with reference to FIGS. 4 to 6.

Figure 4:
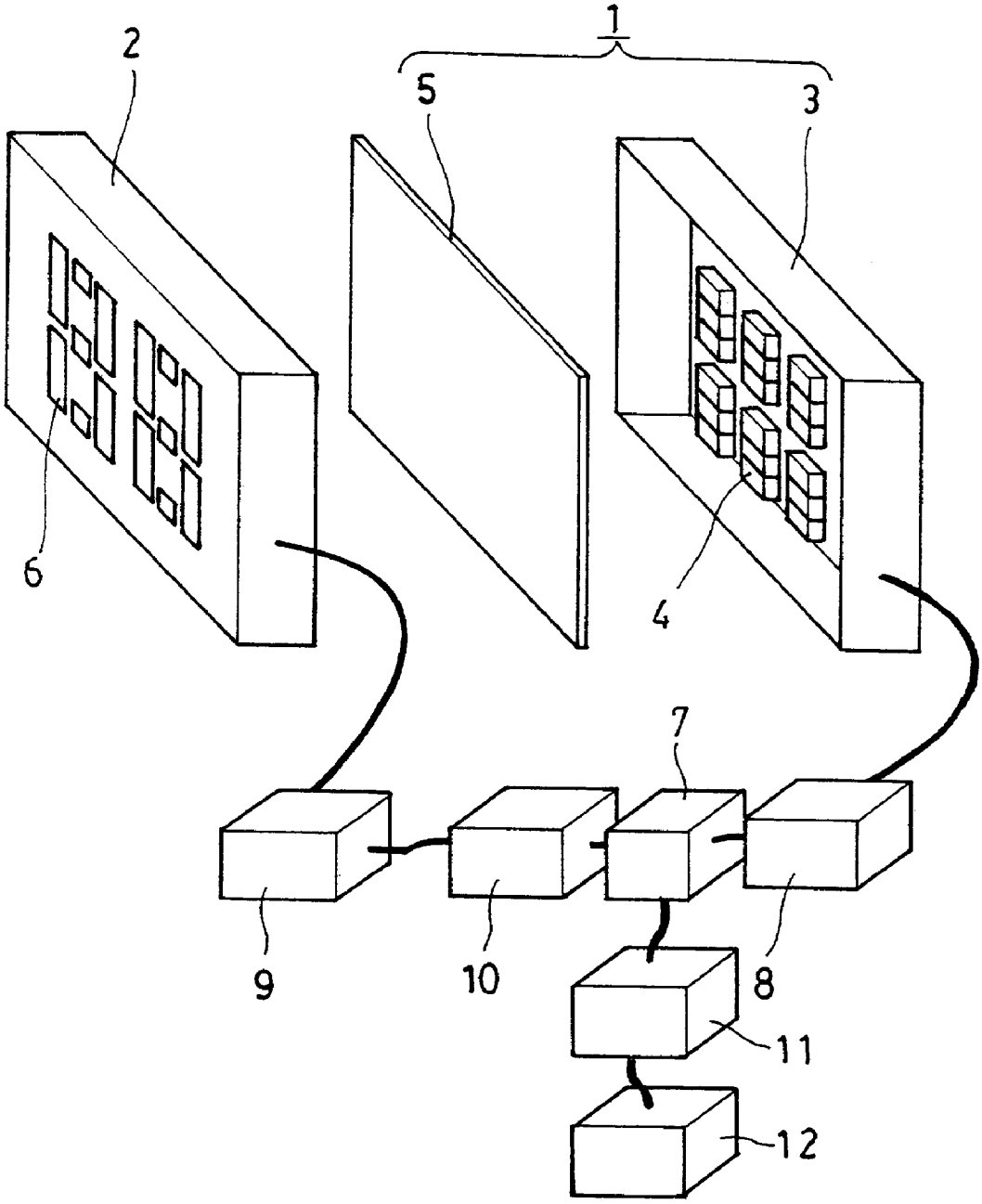
Figure 5:
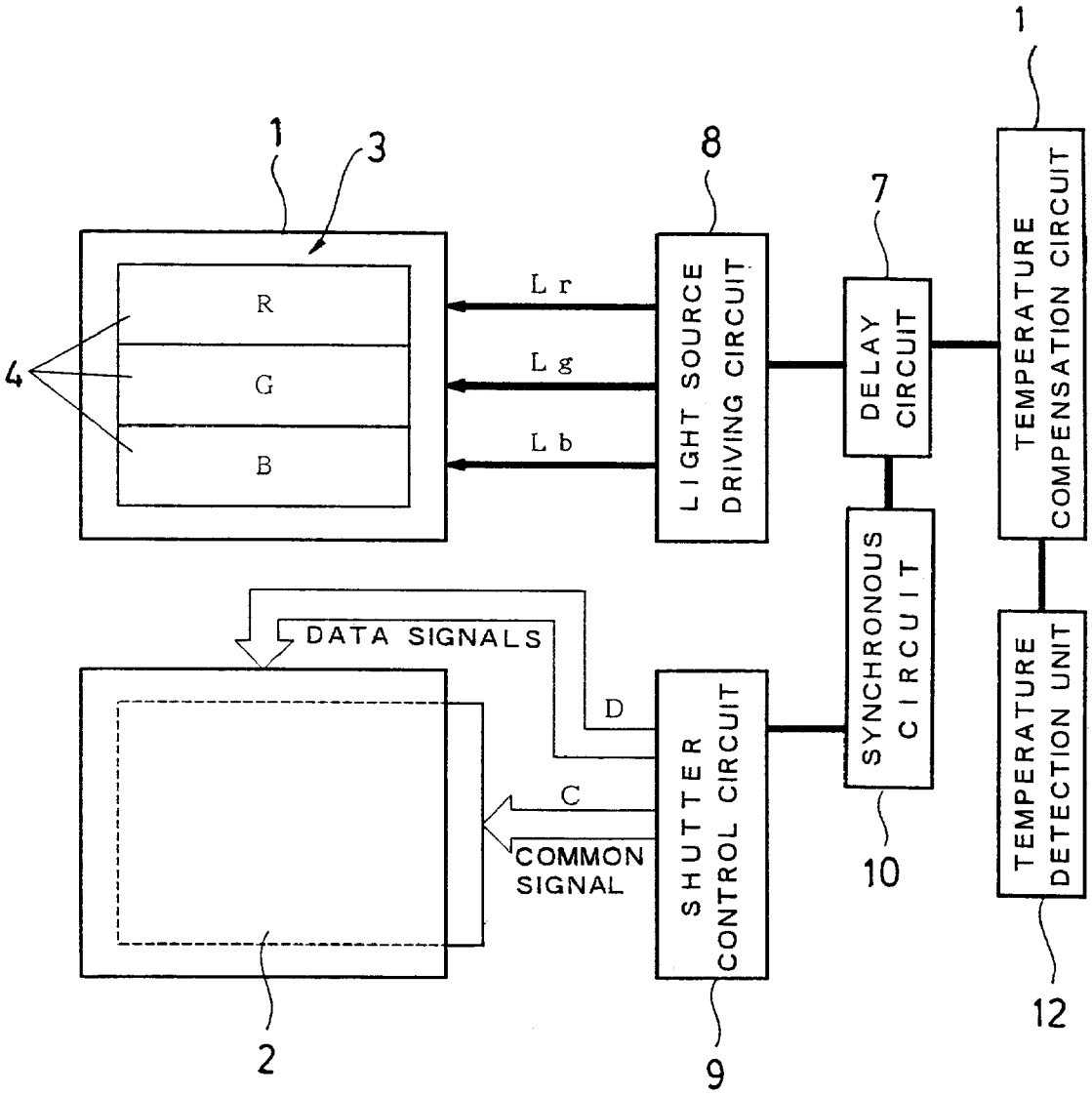
Figure 6:
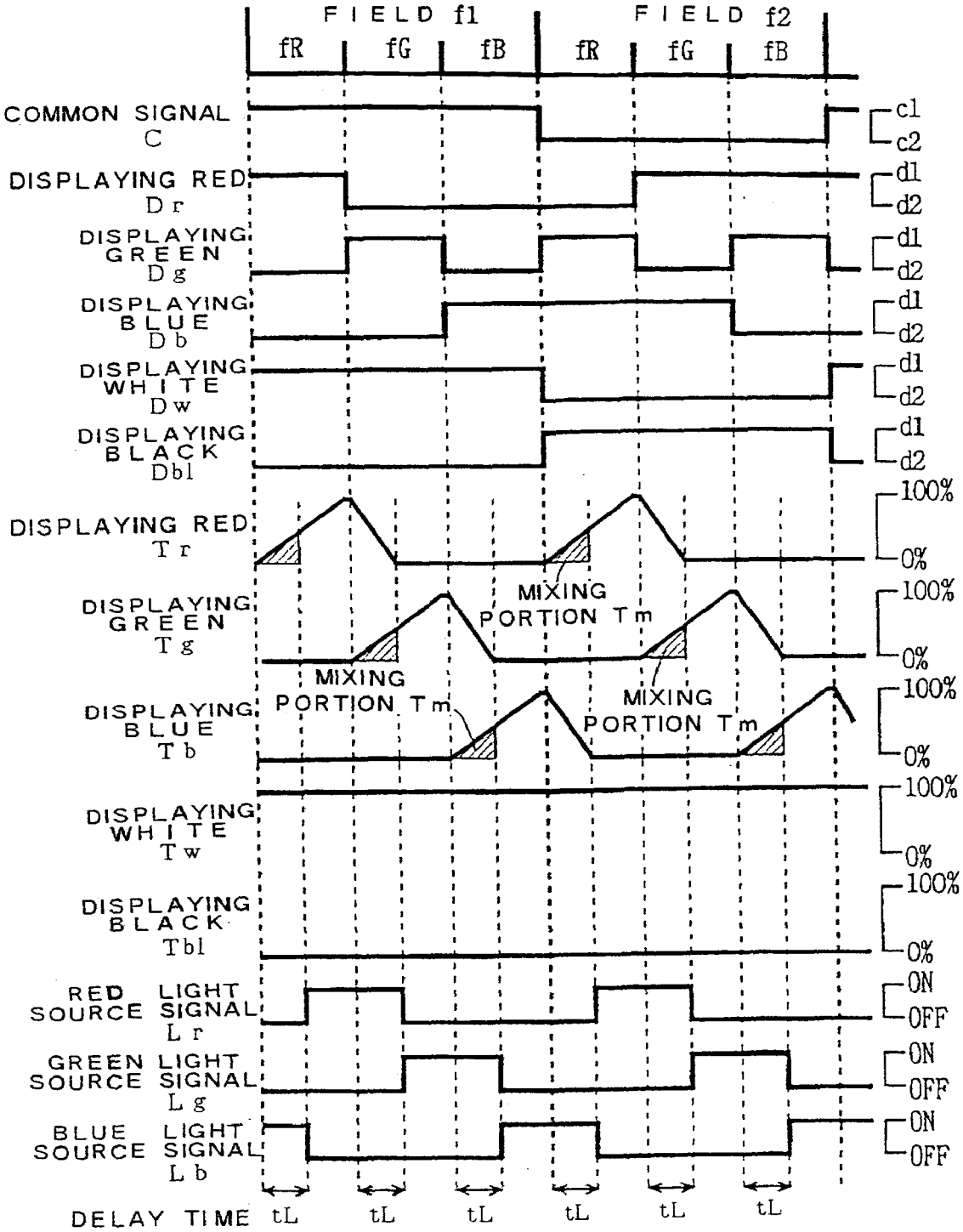

FIGS. 4 to 6 correspond to FIGS. 1 to 3 in the aforementioned first embodiment, described hereinbefore, and parts which are the same as those previously described with reference to FIGS. 1 and 3 are denoted by the same reference numerals, and description thereof is omitted.

The second embodiment is different from the first embodiment in respect of the provision of a temperature detection unit 12 for detecting an ambient temperature and a temperature compensation circuit 11 for changing the delay time tL of the synchronizing signal by the delay circuit 7 in response to the temperature detected by the temperature detection unit 12.

Accordingly, in the second embodiment, the lighting timing of respective color light sources of the light source unit 1 by the light source driving circuit 8 can be delayed by a delay time corresponding to the on response time from the "open" to the "closed" state which varies owing to the ambient temperature at the driving voltage of 9V of the liquid crystal shutter unit 2 relative to the opening and closing timing of the liquid crystal shutter unit 2 by the shutter control circuit 9.

Figure 14:
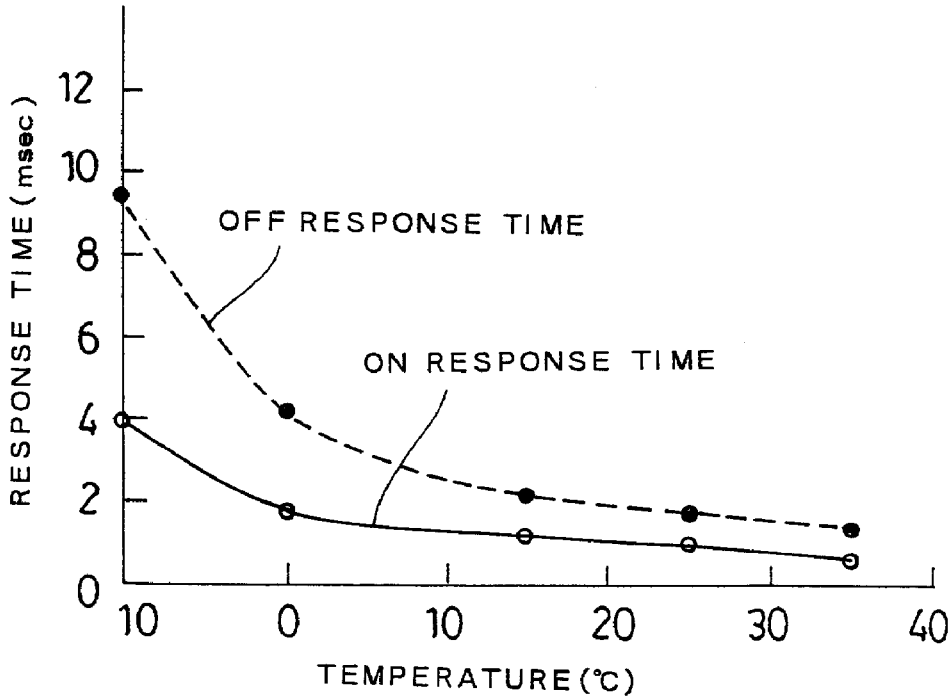
FIG. 14 is a graph showing dependency characteristic of the response time of the liquid crystal shutter used in the liquid crystal shutter unit of the field sequential type color display system relative to temperature.

The temperature characteristic of the response time of the STN liquid crystal panel is shown in FIG. 14. The solid line shows the ON response time from the "open" to the "closed" state at the driving voltage of 9V and the dotted line shows the OFF response time from the "closed" to the "open" state at the time when the driving voltage is returned to 0V.

It is understood from this view that both the ON and OFF response times slow down as the temperature decreases. Further, since the solid line is always positioned under the dotted line, it is understood that the OFF response time is two or three times as slow as the ON response time at any temperature.

FIG. 6 is a waveform chart showing waveforms of respective signals and the optical response characteristic of the liquid crystal shutter unit 2 at ambient temperature of 0° C. according to the second embodiment of the invention. A liquid crystal shutter unit driving signal and a light source driving signal are in principle the same as those of the first embodiment shown in FIG. 3, but the delay time tL is different.

The response time of the liquid crystal shutter unit 2 slows down at low temperature and the OFF response time from the "closed" to the "open" state of the STN liquid crystal panel at 0° C. is about 4 ms and the ON response time from the "open" to the "closed" state is about 2 ms as understood from FIG. 14. Accordingly, the temperature compensation circuit 11 controls the delay circuit 7 so as to render the delay time tL to be about 2 ms corresponding to the on response time.

In FIG. 6, the transmittivity Tr, representing the optical response characteristic of the liquid crystal shutter unit 2 when displaying red, reaches 100%, i.e., the "open" state, in the field f1 about 4 ms behind the time when the data signal Dr for displaying red switches to the OFF voltage d1. On the other hand, the transmittivity reaches 0%, i.e., the "closed" state, about 2 ms behind the time when the data signal Dr switches to the ON voltage d2.

Since the red light source signal Lr is applied with a delay of 2 ms which is the delay time tL in the sub-field fR of the liquid crystal shutter unit, it remains applied until the liquid crystal shutter unit completely closes, which does not mix with the green light source G.

However, since the blue light source signal Lb remains applied for a period of about 2 ms from the beginning of the span of the sub-field fR, mixing between the red light source R and blue light source B occurs. However, the mixing portion Tm in this embodiment is about half compared with the case where there is no delay time tL since the ON response time is twice the OFF response time, thereby reducing the degradation of chroma.

As shown in FIG. 14, since the OFF response time from the "closed" to the "open" state is two to three times as slow as the ON response time from the "open" to the "closed" state at any temperature, when the delay time tL is set to a time corresponding to the ON response time of the STN liquid crystal panel at various temperatures, the amount of the color mixing portion Tm of the liquid crystal shutter can be reduced to half to one third as compared with the case where there is no delay time tL at any temperature, thereby reducing the degradation of chroma.

In such a manner, the field-sequential type color display system according to the second embodiment can display with high chroma and high saturation at low temperatures of 0° C. or lower even if the STN liquid crystal panel is adopted for the liquid crystal shutter unit, thereby expanding the operable temperature range, in a low temperature zone, compared with conventional systems.

Although the first and second embodiments have been set forth hereinbefore, in the case where the driving voltage of the liquid crystal shutter unit is 9V, an improvement of the color saturation can be further enhanced by providing the delay time tL since the OFF response time from the "closed" to the "open" state is hardly changed while the ON response time of the STN liquid crystal panel from the "open" to the "closed" state increases even if the driving voltage is greater than 9V.

Third embodiment (FIGS. 7 and 8):

The color display system according to the third embodiment of the invention will now be described with reference to FIGS. 7 and 8.

Figure 7:
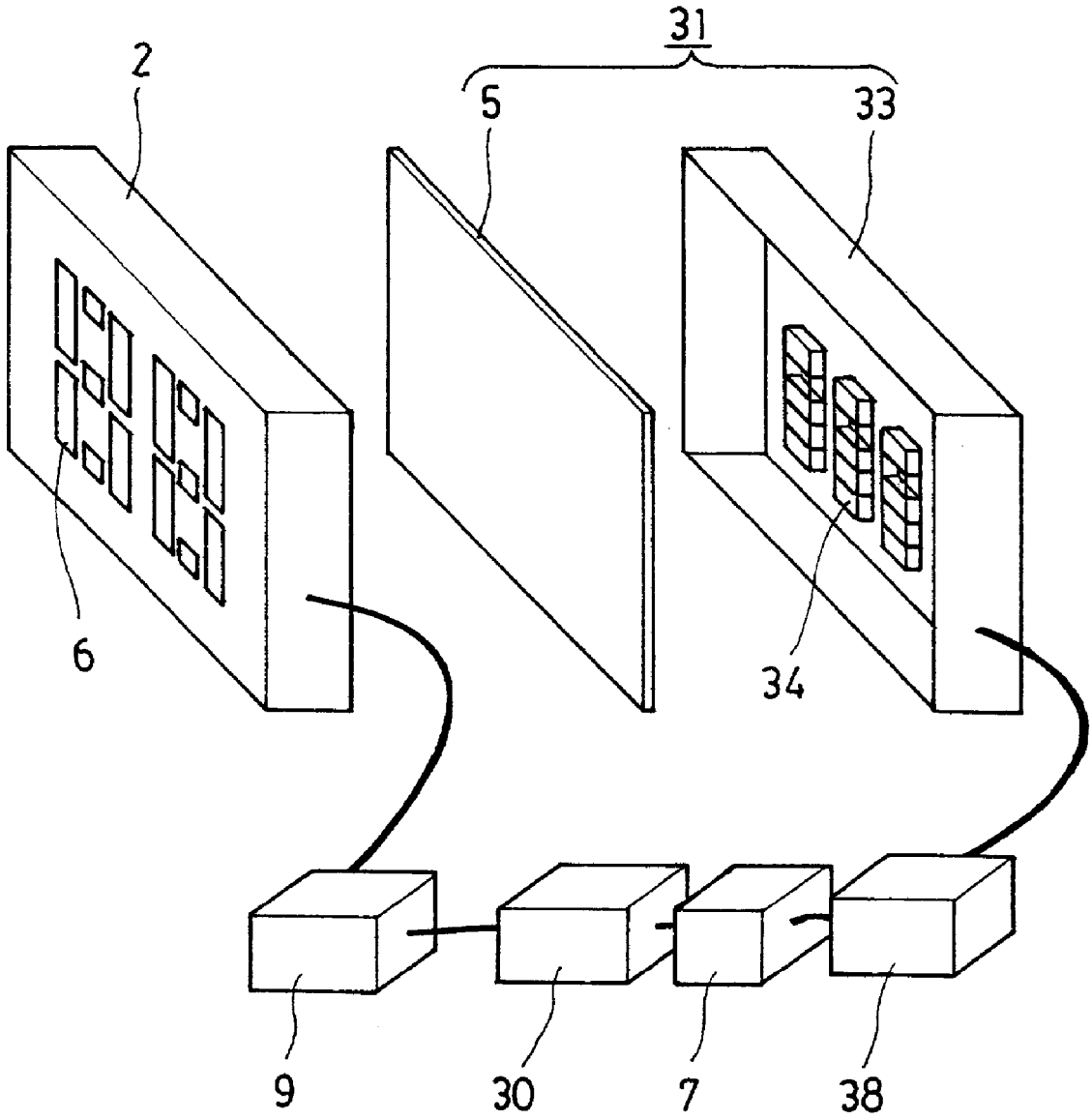
Figure 8:
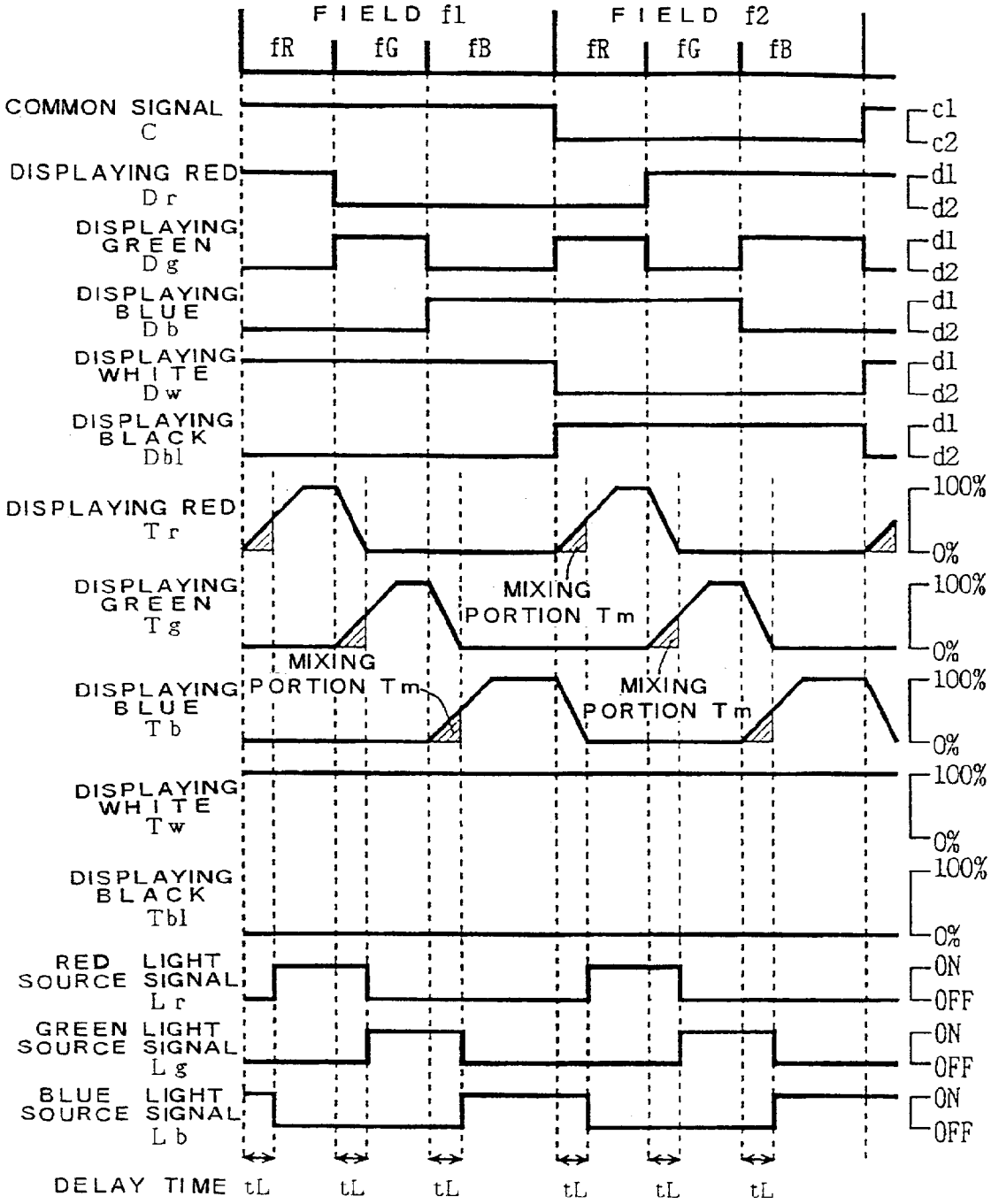

FIGS. 7 and 8 correspond to FIGS. 1 and 3 of the first embodiment, and parts which are same as those of the first embodiment are denoted by the same numerals and hence the explanation thereof is omitted.

The construction of the field sequential type color display system according to the third embodiment shown in FIG. 7 is substantially common to that of the first embodiment shown in FIG. 1.

However, an LED box 33 of a light source unit 31 employed by the third embodiment is common to that of the first embodiment in respect of the arrangement of the LEDs for three colors as the color light sources but the arrangement of LEDs 34 for three colors is different from that of the first embodiment shown in FIG. 1 in that a group in the first embodiment is composed of three each of red, green and blue while a group in the third embodiment is composed of five each of red, green, blue, green and red.

The LEDs 34 for three colors serving as respective color light sources of the light source unit 31 are controlled by a light source driving circuit 38 to be energized in synchronization with a synchronizing signal applied by a synchronous circuit 30 and delayed by the delay circuit 7 by the delay time tL.

The synchronous circuit 30 is slightly different from the synchronous circuit 10 in the first and second embodiments, and it has means for making the span of the sub-field for lighting the color light source of any one color (blue in the third embodiment) of the plurality of sub-fields constituting one field longer than the spans of the sub-fields for lighting the other color light sources.

FIG. 8 is a waveform chart showing waveforms of respective signals and the optical response characteristic of the liquid crystal shutter unit when the driving voltage of the liquid crystal shutter unit 2 is 9V at the ambient temperature of 25° C. according to the color display system of the third embodiment.

There are provided two fields f1 and f2 for driving the liquid crystal shutter by AC, and the respective fields f1 and f2 comprise the three sub-fields fR, fG and fB wherein the span of the sub-field fB for displaying blue is longer than the spans of the sub-field fR and sub-field fG of other two colors.

Since the span of the sub-field fB for displaying blue is made longer in such a manner, a sufficient amount of blue light is secured even if the number of blue LEDs serving as the color light source of blue is small, thereby improving the color balance of white. In the case of employment of the LEDs as the color light sources, since the price of blue LEDs is much higher than the LEDs of other colors, a low-cost color display system can be provided by reducing the number of blue LEDs to be used.

Other constructions, functions and effects of the third embodiment are the same of those of the first embodiment.

In the third embodiment, although the number of LEDs for three color display is changed to reduce the number of LEDs for the blue color, and the spans of the sub-fields are changed according to color, it is possible to improve the color balance for displaying white by changing only the spans of sub-fields according to colors without changing the number of LEDs to be used for three colors.

Further, the explanation set forth hereinbefore relates to a case where the color display system is driven at room temperature but it is also possible to expand the operable temperature range in a low temperature zone by providing the temperature detection unit 12 and the temperature compensation circuit 11 so as to vary the delay time tL by the delay circuit 7 in response to the temperatures detected thereby.

Fourth Embodiment (FIGS. 9 and 10):

The color display system according to the fourth embodiment of the present invention is first described with reference to FIGS. 9 and 10.

Figure 9:
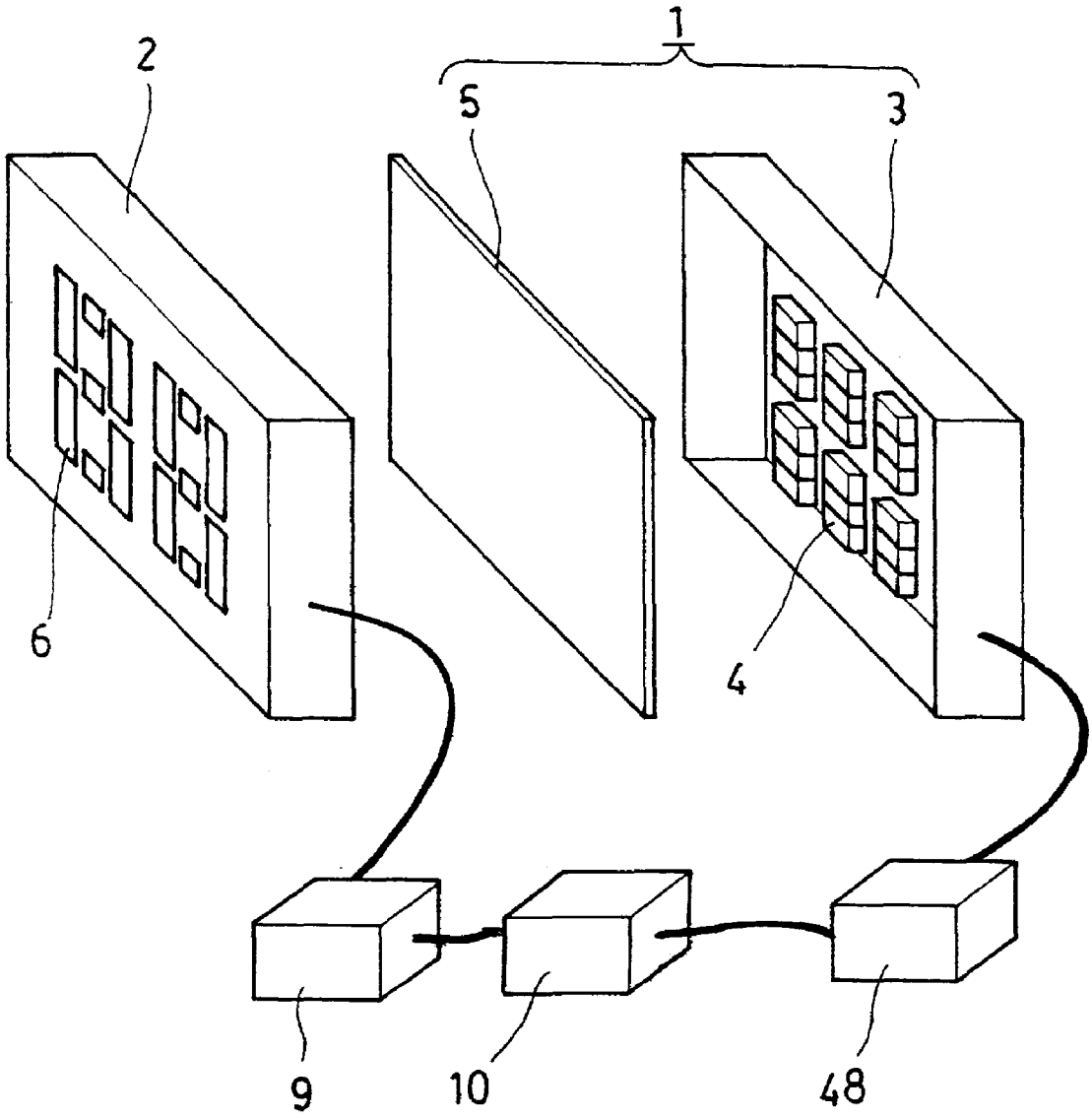
Figure 10:
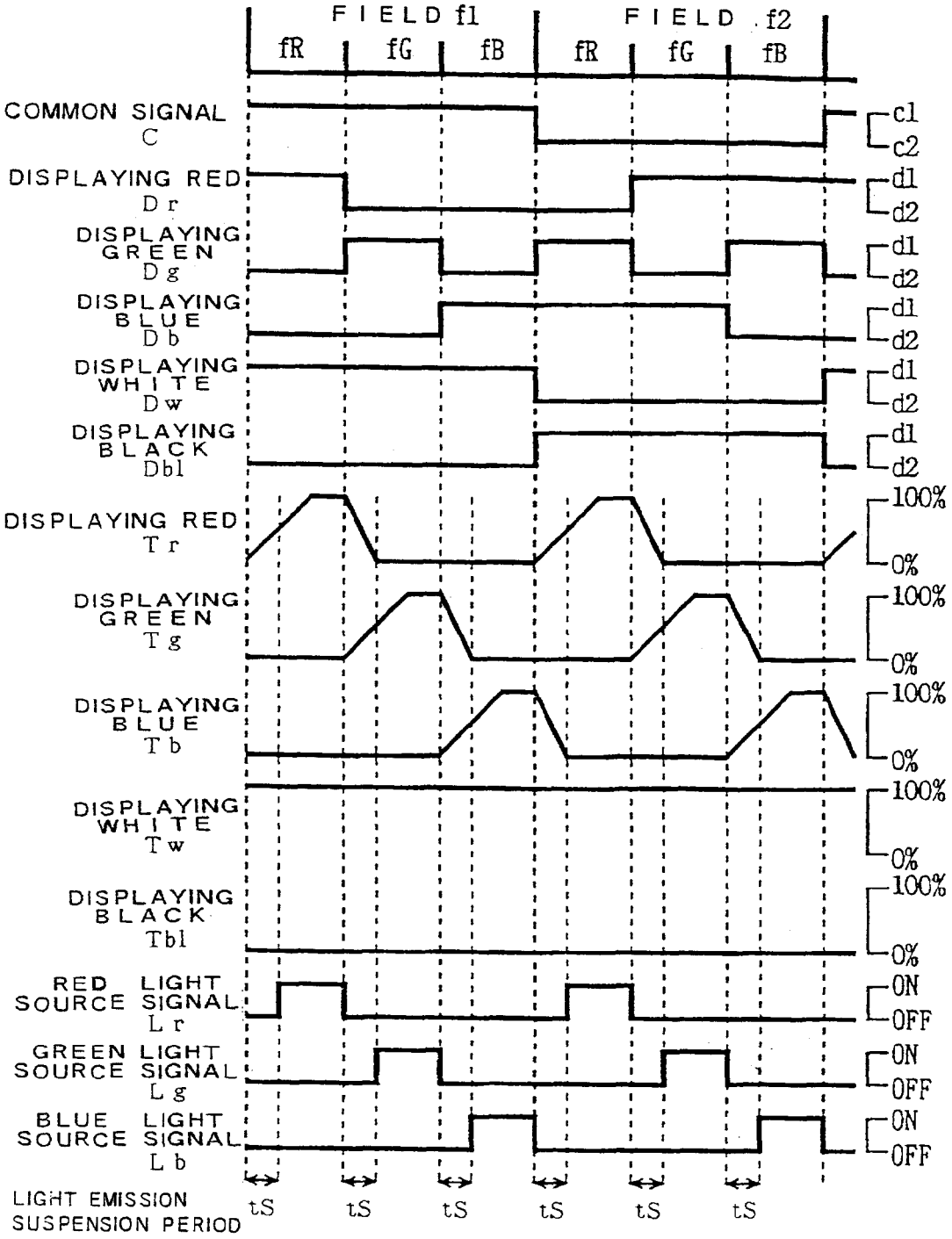

FIGS. 9 and 10 respectively correspond to FIGS. 1 and 3 in the first embodiment described hereinbefore, and parts which are the same as those previously described with reference to FIGS. 1 and 3 are denoted by the same reference numerals, and description thereof is omitted.

As shown in FIG. 9, the field sequential type color display system according to the fourth embodiment of the invention has the construction of the first embodiment shown in FIG. 1 with the delay circuit 7 excluded, substantially similar to that of the conventional example, shown in FIG. 15.

In the fourth embodiment, however, the light source driving circuit 48 for driving the light source unit 1 and controlling lighting of the respective color light sources composed of LEDs 4 for three colors, respectively, differs from the light source driving circuit 8 or 38 shown with reference to various embodiments of the invention and the conventional example as described hereinbefore.

The light source driving circuit 48 has means for providing light emission suspension periods substantially corresponding to a response time of the liquid crystal shutter unit 2 from the "open" to the "closed" state at the beginning of lighting periods of the respective color light sources by the LEDs 4 for the three colors of the light source unit 1.

FIG. 10 shows waveforms of respective signals at room temperature and the optical response characteristic of the liquid crystal shutter unit 2 in the color display system according to the fourth embodiment.

The waveforms of the respective signals correspond to those of the first embodiment shown in FIG. 3. Instead of delaying the lighting signals outputted to the LEDs 4 for the three colors composing the light source unit 1 from the light source driving circuit 48, that is, the red light source signal Lr, green light source signal Lg, and blue light source signal Lb, light emission suspension periods tS are provided at the beginning of the respective lighting periods while light-out times coincide with switch-over times of the respective sub-fields as in the case of the conventional example.

Accordingly, the red light source is energized only for the span of the sub-field fR of the liquid crystal shutter unit except for the light emission suspension periods tS, and remains unlit in the other sub-fields fG, and fB. Similarly, the green light source is energized only for the span of the sub-field fG of the liquid crystal shutter unit except for the light emission suspension period tS, and remains unlit in the other sub-fields fB, and fR, and the blue light source is energized only for the span of the sub-field fB of the liquid crystal shutter unit except for the light emission suspension period tS, and remains unlit in the other sub-fields fR, and fG.

As response times of the LEDs, which are semiconductors, are very fast, the light emission characteristics of the red light source signal Lr, green light source signal Lg, and blue light source signal Lb are regarded as the same as that of the respective LEDs in the case that the LED box 3 is adopted for the light source unit 1.

In the fourth embodiment as well, a driving voltage applied to the liquid crystal shutter unit 2 is lowered to 9V, thereby slowing down the ON response time of the STN liquid crystal panel from the "open" to the "closed" state to about 1 ms although the OFF response time thereof from the "closed" to the "open" state remains the same at about 2 ms. Accordingly, the light emission suspension periods tS are set for a length of time equivalent to the ON response time, about 1 ms.

Transmittivity Tr representing the optical response characteristic of the liquid crystal shutter unit 2 when displaying red reaches 100%, that is, the "open" state, in the sub-field fR about 2 ms behind the time when the data signal Dr for displaying red switches to the OFF voltage d1, and 0%, that is, the "closed" state, in the sub-field fG about 1 ms behind the time when the data signal Dr switches to the ON voltage d2.

However, for a period of 1 ms from the beginning of the span of the sub-field fG, the green light source signal Lg is still in the light emission suspension period tS and hence the green light source does not light up with the result that color mixing by light from the green light source G does not occur. Thus a display characteristic of excellent color is exhibited even at a low driving voltage.

The red light source signal Lr and blue light source signal Lb are also provided with the light emission suspension periods tS, respectively, and hence mixing of colors does not occur either when displaying green and blue, respectively, although the luminance of white is slightly lowered, still exhibiting a similar display characteristic of excellent color.

Thus with the field-sequential type color display system according to the fourth embodiment of the invention wherein the STN liquid crystal panel is adopted for the liquid crystal shutter unit, color display of high saturation with high chroma is attained even when the driving voltage is set at a low voltage on the order of 9V. This enables adoption of driving IC and a power supply circuit which are available at low-cost, and consequently, a low-cost color display system can be provided.

In the fourth embodiment, the light emission suspension periods tS are set to a period equivalent to the ON response time of the liquid crystal panel. However, if the periods tS are longer than the ON response time, the same effect is achieved although the amount of light emitted is reduced.

Further, in the fourth embodiment, it is also possible to expand the operable temperature range in the low temperature zone by providing a temperature detection unit and a temperature-compensating circuit so as to vary the light emission suspension periods tS by the light source driving circuit 48 in response to the temperatures detected thereby.

Fifth Embodiment (FIGS. 11 and 12):

The color display system according to the fifth embodiment of the present invention is first described with reference to FIGS. 11 and 12.

Figure 11:
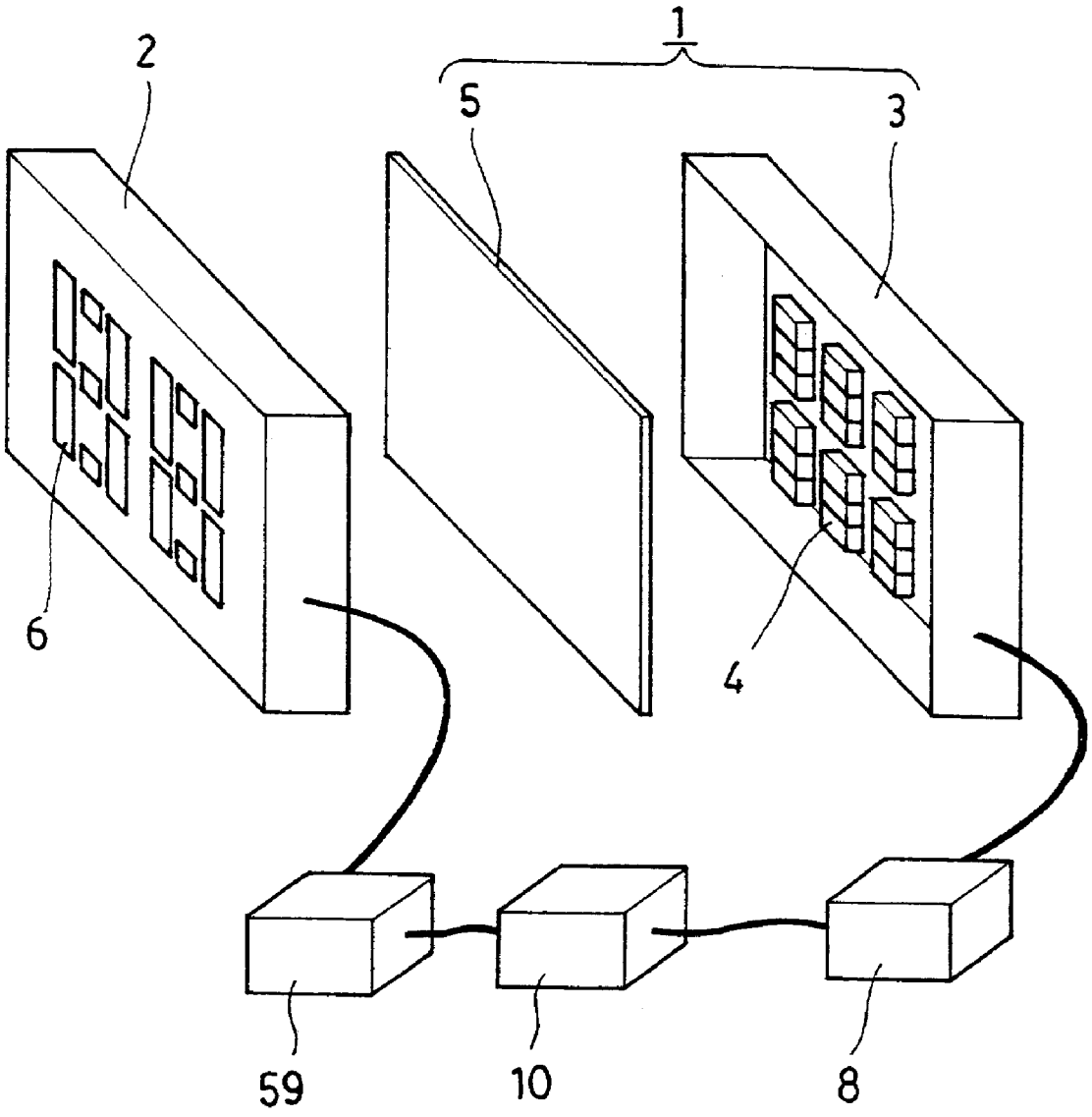
Figure 12:
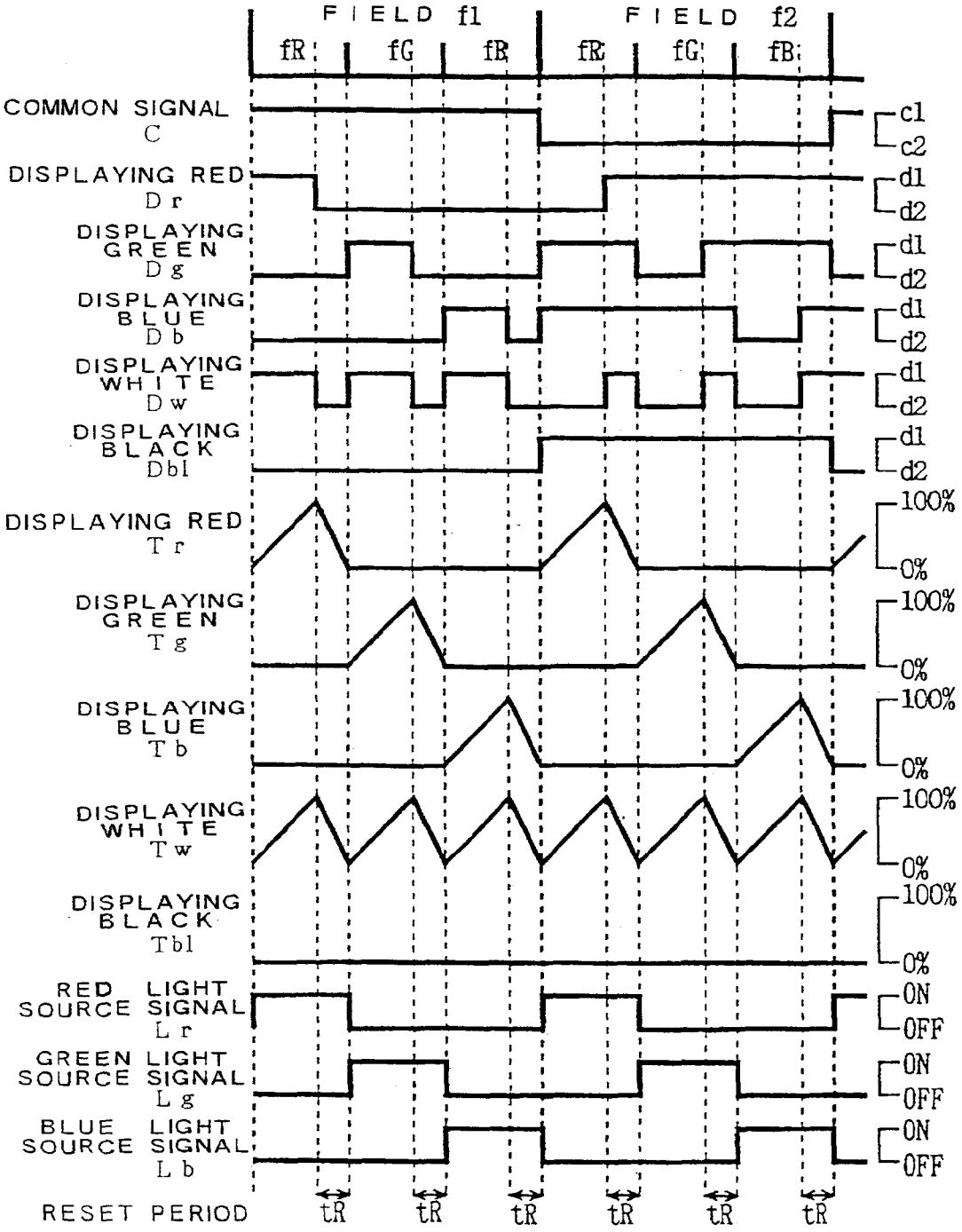

FIGS. 11 and 12 correspond to FIGS. 9 and 10 in the fourth embodiment described hereinbefore, and parts which are the same as those previously described with reference to FIGS. 9 and 10 are denoted by the same reference numerals, and description thereof is omitted.

As shown in FIG. 11, a field sequential type color display system according to the fifth embodiment of the invention has a construction substantially similar to that of the fourth embodiment shown in FIG. 9.

In the fifth embodiment, however, the light source driving circuit 8, which is the same as that in the first embodiment shown in FIG. 1 is used, and a shutter control circuit 59 for controlling a liquid crystal shutter unit 2 differs from the shutter control circuit 9 used in the other embodiments described.

The shutter control circuit 59 has means for providing a reset period substantially corresponding to a response time of the liquid crystal shutter unit 2 from the "open" to the "closed" state at the end of the span of the respective sub-fields of shutter control signals for controlling opening and closing of the liquid crystal shutter unit 2.

In this embodiment, the liquid crystal shutter unit 2 is controlled such that the span of the "open" state is made shorter, by about 1 ms, corresponding to the on response time thereof at a driving voltage of 9V, than respective light source lighting periods by providing the reset period.

FIG. 12 shows waveforms of respective signals at room temperature and the optical response characteristic of the liquid crystal shutter unit 2 in the color display system according to the fifth embodiment.

Since a STN liquid crystal panel in normally white mode is used as the liquid crystal shutter unit 2 in this embodiment, a data signal Db1 for displaying black is in opposite phase with the common signal C, and a difference in voltage between the common signal C and the data signal Db1 is applied to the liquid crystal panel, switching the same to the ON state. Further, voltages c1 and c2 of the common signal C, and voltages d1 and d2 of the data signals D, are adjusted such that the driving voltage becomes 9V.

Accordingly, a low-cost IC having a break down voltage at 10V can be used for the driving IC, and a booster circuit is unnecessary when the color display system is used as a car-mounted display because the driving circuit can be directly driven by a car battery at 12V.

When a data signal Dw for displaying white, which is in phase with that of the common signal C, is supplied, no voltage is applied to the liquid crystal panel, switching the same to the OFF state. However, during the reset period tR, both signals are in opposite phases, turning the liquid crystal panel into the ON state, and reducing the amount of light transmit.

The data signal Dr for displaying red takes a voltage so as to cause the liquid crystal shutter unit to be in the "open" state for the span of the sub-field fR, but the driving voltage is applied thereto during the reset period tR corresponding to an ON response time of the liquid crystal panel to force the same to be in the "closed" state.

Because the driving voltage of the liquid crystal shutter unit 2 is as low as 9V, the ON response time of the STN liquid crystal panel from the "open" to the "closed" state slows down to about 1 ms while the OFF response time of the same from the "closed" to the "open" state remains 2 ms. Accordingly, the reset period tR is set to a period corresponding to approximately 1 ms which is the on response time thereof.

In this embodiment, transmittivity Tr representing the optical response characteristic of the liquid crystal shutter unit 2 when displaying red reaches 100%, that is, the "open" state, in field f1 about 2 ms behind the time when the data signal Dr for displaying red switches to the OFF voltage d1. On the other hand, the transmittivity Tr reaches 0%, that is, the "closed" state, about 1 ms behind the time when the data signal Dr switches to the on voltage d2 during the reset period tR.

As the STN liquid crystal panel is completely in the "closed" state for the span of the sub-field fG, color mixing by light from the green light source G does not occur, and a display characteristic of excellent color is exhibited even at a low driving voltage.

Data signals Dg and Db for displaying green and blue, respectively, are also provided with the reset period tR, preventing color mixing when displaying green and blue, with the result that a display characteristic of excellent chroma can be exhibited as well.

As described in the foregoing, with the color display system according to the fifth embodiment of the invention wherein the STN liquid crystal panel is adopted for the liquid crystal shutter unit, color display of high saturation with high chroma is attained even when the driving voltage is set at a low voltage on the order of 9V. This enables adoption of driving IC circuits and a power supply circuit which are available at low-cost, and consequently, a low-cost color display system can be provided.

In the fifth embodiment, the reset period tR is set to a period equivalent to the ON response time of the liquid crystal panel. However, if the same is longer than the ON response time, the same effect is achieved although the amount of light transmitted is reduced.

In the fifth embodiment as well, it is possible to expand the operable temperature range in a low temperature zone by providing a temperature detection unit and a temperature-compensating circuit so as to vary the reset period tR by the shutter control circuit 59 depending on temperatures detected thereby.

Furthermore, with the fourth and fifth embodiments described hereinbefore, it is possible to improve color saturation when displaying white, or reduce the number of LEDs for expensive LED colors by differentiating the span of a sub-field corresponding to a specific color light source from those for other color light sources. As a result, a field-sequential type color display system, having excellent color balance and a wide operating temperature range in a low temperature zone, can be provided at a low-cost.

Industrial Applicability

As described in the foregoing, with the field-sequential type color display system according to the invention, wherein the liquid crystal shutter is used in the liquid crystal shutter unit, color display with high chroma can be achieved even when the driving voltage is set to a low voltage, enabling use of driving IC and a driving circuit which are available at low-cost. Hence, the color display system can be provided at a low-cost.

Further, degradation in chroma in display in a low temperature can be prevented by providing a temperature detection unit and a temperature-compensating circuit and varying a delay time or the like, depending on temperatures detected, so that the delay time or the like is always set to a duration corresponding to the ON response time of the liquid crystal panel. Thus, the color display system of the field-sequential type according to the invention can be used even at a temperature below 0° C., expanding the operable temperature range in a low temperature zone.

In addition, it has become possible to improve color saturation when displaying white, or reduce the number of LEDs for an expensive LED color such as blue by differentiating the span of a sub-field corresponding to a specific color light source from those for other color light sources, thereby providing a field-sequential type color display system having excellent color balance and high chroma at a low-cost.

What is claimed is:

1. A field-sequential type color display system comprising:

a light source unit composed of a plurality of color light sources which emit light rays of different wavelengths, respectively, and can be controlled independently of one another;

a light source driving circuit for driving the light source unit;

a liquid crystal shutter unit for controlling transitivity of light rays emitted by the light source unit;

a shutter control circuit for controlling the liquid crystal shutter unit; and a synchronous circuit for synchronizing the light source driving circuit with the shutter control circuit, wherein a field is composed of a plurality of sub-fields corresponding to the plurality of color light sources of the light source unit, and multicolor display is effected by energizing the color light sources for specific colors against the respective sub-fields and by controlling the liquid crystal shutter unit according to the respective sub-fields, characterized in that the color display system further comprises a delay circuit whereby lighting times of the respective color light sources of the light source unit are delayed from a time for controlling opening and closing of the liquid crystal shutter unit as set by the synchronous circuit by a delay time substantially equivalent to a response time of the liquid crystal shutter unit from an "open" to a "closed" state, and wherein the color display system further comprises a temperature detection unit for detecting an ambient temperature, and a temperature-compensating circuit for varying the delay time by means of the delay circuit according to temperatures detected by the temperature detection unit.

2. A field-sequential type color display system comprising:

a light source unit composed of a plurality of color light sources which emit light rays of different wavelengths, respectively, and can be controlled independently of one another;

a light source driving circuit for driving the light source unit;

a liquid crystal shutter unit for controlling transitivity of light rays emitted by the light source unit;

a shutter control circuit for controlling the liquid crystal shutter unit; and a synchronous circuit for synchronizing the light source driving circuit with the shutter control circuit, wherein a field is composed of a plurality of sub-fields corresponding to the plurality of color light sources of the light source unit, and multicolor display is effected by energizing the color light sources for specific colors against the respective sub-fields and by controlling the liquid crystal shutter unit according to the respective sub-fields, characterized in that the color display system further comprises a delay circuit whereby lighting times of the respective color light sources of the light source unit are delayed from a time for controlling opening and closing of the liquid crystal shutter unit as set by the synchronous circuit by a delay time substantially equivalent to a response time of the liquid crystal shutter unit from an "open" to a "closed" state, and the color display system is characterized in that the synchronous circuit has means for rendering the span of one of the plurality of sub-fields constituting the field, during which any of the color light sources is energized, longer than the span of any other of the sub-fields, during which other of the color light sources is energized.

3. A field-sequential type color display system comprising:

a light source unit composed of a plurality of color light sources which emit light rays of different wavelengths, respectively and can be controlled independently of one another;

a light source driving circuit for driving the light source unit;

a liquid crystal shutter unit for controlling transitivity of light rays emitted by the light source unit;

a shutter control circuit for controlling the liquid crystal shutter unit; and a synchronous circuit for synchronizing the light source driving circuit with the shutter control circuit, wherein a field is composed of a plurality of sub-fields corresponding to the plurality of color light sources of the light source unit, and multicolor display is effected by energizing the color light sources for specific colors against the respective sub-fields and by controlling the liquid crystal shutter unit according to the respective sub-fields, characterized in that the color display system further comprises a delay circuit whereby lighting times of the respective color light sources of the light source unit are delayed from a time for controlling opening and closing of the liquid crystal shutter unit as set by the synchronous circuit by a delay time substantially equivalent to a response time of the liquid crystal shutter unit from an "open" to a "closed" state, and wherein the color display system further comprises a temperature detection unit for detecting an ambient temperature, and a temperature-compensating circuit for varying the delay time by means of the delay circuit according to temperatures detected by the temperature detection unit, and the color display system is characterized in that the synchronous circuit has means for rendering the span of one of the plurality of sub-fields constituting the fields, during which any of the color light sources is energized, longer than the span of any other of the sub-fields, during which other of the color light sources is energized.

* * * * *